US011427881B2

(12) United States Patent
Hamada et al.

(10) Patent No.: US 11,427,881 B2
(45) Date of Patent: Aug. 30, 2022

(54) FERRITE-BASED STAINLESS STEEL PLATE, STEEL PIPE, AND PRODUCTION METHOD THEREFOR

(71) Applicant: NIPPON STEEL & SUMIKIN STAINLESS STEEL CORPORATION, Tokyo (JP)

(72) Inventors: Junichi Hamada, Tokyo (JP); Kou Nishimura, Tokyo (JP); Jun Araki, Tokyo (JP); Nozomu Fukuda, Tokyo (JP); Toshio Tanoue, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 55 days.

(21) Appl. No.: 17/130,634

(22) Filed: Dec. 22, 2020

(65) Prior Publication Data

US 2021/0108283 A1 Apr. 15, 2021

Related U.S. Application Data

(62) Division of application No. 15/521,465, filed as application No. PCT/JP2015/080268 on Oct. 27, 2015, now abandoned.

(30) Foreign Application Priority Data

Oct. 31, 2014 (JP) ..... 2014-222202
Nov. 21, 2014 (JP) ..... 2014-236113

(51) Int. Cl.

| | |
|---|---|
| ***C21D 9/46*** | (2006.01) |
| ***C22C 38/60*** | (2006.01) |
| ***C22C 38/28*** | (2006.01) |
| ***C21D 6/00*** | (2006.01) |
| ***C21D 8/02*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/00*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0268* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/28* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/60* (2013.01); *C21D 2211/005* (2013.01)

(58) Field of Classification Search
None
See application file for complete search history.

(56) References Cited

U.S. PATENT DOCUMENTS

| | | | |
|---|---|---|---|
| 2002/0012602 | A1 | 1/2002 | Takahashi et al. |
| 2004/0055673 | A1 | 3/2004 | Kimura et al. |
| 2007/0170226 | A1 | 7/2007 | Ono et al. |
| 2012/0014830 | A1 | 1/2012 | Hamada et al. |
| 2013/0017116 | A1 | 1/2013 | Hatano et al. |

(Continued)

FOREIGN PATENT DOCUMENTS

| | | | |
|---|---|---|---|
| CN | 1491290 | A | 4/2004 |
| CN | 101255532 | A | 9/2008 |

(Continued)

OTHER PUBLICATIONS

Hamada, Jun Ichi, Jun Ichi Ono, and Hirofumi Inoue. "Effect of Texture on R-Value of Ferritic Stainless Steel Sheets." ISIJ International 51.10 (2011): 1740-1748. ISIJ International. Web. (Year: 2011).*

Chinese Office Action and Search Report, dated Nov. 23, 2017 for Chinese Application No. 201580055154.3, with an English translation of the Chinese Office Action.

International Preliminary Report on Patentability and English Translation of Written Opinion of the International Searching Authority, dated May 2, 2017, issued in PCT/JP2015/080268 (Forms PCT/IB/373 and PCT/ISA/237).

International Search Report (PCT/ISA/210) issued in PCT/JP2015/080268, dated Jan. 26, 2016.

(Continued)

*Primary Examiner* — Anthony M Liang

(74) *Attorney, Agent, or Firm* — Birch, Stewart, Kolasch & Birch, LLP

(57) ABSTRACT

A ferritic stainless steel sheet and a steel pipe as a material suitable for a heat-resistant component that is required to have especially excellent formability are provided. The ferritic stainless steel sheet contains 10 to 20 mass % of Cr and a predetermined amount of C, Si, Mn, P, S, Al and one or both of Ti and Nb, a {111}-orientation intensity being 5 or more and {411}-orientation intensity being less than 3 at a portion in the vicinity of a sheet-thickness central portion of the ferritic stainless steel sheet. Further, with similar composition and by setting {111}<110>-orientation intensity at 4.0 or more and {311}<136>-orientation intensity at less than 3.0, a relationship $r_m \geq -1.0t+3.0$ (t(mm): sheet thickness, $r_m$: average r-value) is satisfied, thereby providing a ferritic stainless steel sheet and a steel pipe with excellent formability.

14 Claims, 4 Drawing Sheets

(56) References Cited

U.S. PATENT DOCUMENTS

| | | | |
|---|---|---|---|
| 2013/0183190 | A1 | 7/2013 | Nakamura et al. |
| 2014/0023432 | A1 | 1/2014 | Matsuhashi et al. |
| 2014/0216614 | A1 | 8/2014 | Hatano et al. |
| 2015/0292068 | A1 | 10/2015 | Teraoka et al. |
| 2015/0376732 | A1 | 12/2015 | Hamada et al. |

FOREIGN PATENT DOCUMENTS

| | | | |
|---|---|---|---|
| EP | 2 557 194 | A1 | 2/2013 |
| EP | 2 871 251 | A1 | 5/2015 |
| JP | 7-62495 | A | 3/1995 |
| JP | 9-256051 | A | 9/1997 |
| JP | 2002-060972 | A | 2/2002 |
| JP | 2002-060973 | A | 2/2002 |
| JP | 2002-097552 | A | 4/2002 |
| JP | 2002-285300 | A | 10/2002 |
| JP | 2002-363711 | A | 12/2002 |
| JP | 2002-363712 | A | 12/2002 |
| JP | 2004-002974 | A | 1/2004 |
| JP | 2005-163139 | A | 6/2005 |
| JP | 2005-314740 | A | 11/2005 |
| JP | 2005-325377 | A | 11/2005 |
| JP | 2006-089814 | A | 4/2006 |
| JP | 2006-193771 | A | 7/2006 |
| JP | 2006-274419 | A | 10/2006 |
| JP | 4065579 | B2 | 3/2008 |
| JP | 2008-208412 | A | 9/2008 |
| JP | 2009-299116 | A | 12/2009 |
| JP | 4397772 | B2 | 1/2010 |
| JP | 2010-043321 | A | 2/2010 |
| JP | 2010-248620 | A | 11/2010 |
| JP | 4590719 | B2 | 12/2010 |
| JP | 4624808 | B2 | 2/2011 |
| JP | 2012-112020 | A | 6/2012 |
| JP | 2012-188748 | A | 10/2012 |
| TW | 200940199 | A1 | 10/2009 |
| TW | 201139698 | A1 | 11/2011 |
| TW | 201247899 | A1 | 12/2012 |
| TW | 201307582 | A1 | 2/2013 |
| TW | 201406970 | A | 2/2014 |
| TW | 201435098 | A | 9/2014 |
| WO | WO 2012/050226 | A1 | 4/2012 |
| WO | WO 2014/069543 | A1 | 5/2014 |

OTHER PUBLICATIONS

Japanese Office Action dated Mar. 19, 2019, for Japanese Patent Application No. 2016-556584, with English translation.

Office Action issed in Taiwanese Patent Application No. 104135605 dated May 25, 2016.

Office Action issued in Japanese Patent Application No. 2014-236113 dated Sep. 15, 2015.

U.S. Office Action for U.S. Appl. No. 15/521,465, dated Feb. 20, 2020 (Restriction Requirement).

U.S. Office Action for U.S. Appl. No. 15/521,465, dated Jun. 29, 2020 (Non-Final Rejection).

U.S. Office Action for U.S. Appl. No. 15/521,465, dated Oct. 23, 2020 (Final Rejection).

Written Opinion (PCT/ISA/237) issued in PCT/JP2015/080268, dated Jan. 26, 2016.

* cited by examiner

FERRITE-BASED STAINLESS STEEL PLATE, STEEL PIPE, AND PRODUCTION METHOD THEREFOR

CROSS-REFERENCE TO RELATED APPLICATIONS

This application is a Divisional of copending application Ser. No. 15/521,465, filed on Apr. 24, 2017, which is the national stage entry of and claims priority under 35 U.S.C. § 371 of International Application No. PCT/JP2015/080268, filed on Oct. 27, 2015, and which claims the benefit under 35 U.S.C. § 119(a) to Japanese Patent Application No. JP 2014-222202, filed in Japan on Oct. 31, 2014, and Japanese Patent Application No. JP 2014-236113, filed in Japan on Nov. 21, 2014, all of which are hereby expressly incorporated by reference into the present application.

TECHNICAL FIELD

The present invention relates to a ferritic stainless steel sheet and a steel pipe that are especially suitably usable for a heat-resistant component that is required to have excellent formability and for a molding article that is required to have excellent formability, and a manufacturing method thereof.

BACKGROUND ART

Ferritic stainless steel sheet is used in a variety of applications including household electronic appliances, kitchen instrument and electronic devices. For instance, studies have recently been made for the use of stainless steel sheet for exhaust pipes, fuel tanks and pipes of automobiles and motorcycles. These components require high formability for shape forming, as well as corrosion resistance and heat resistance in an environment in which the components contact with exhaust-gas or fuel. However, the ferritic stainless steel sheet is, though less expensive, inferior in formability to austenitic stainless steel sheet. Accordingly, the usage and shape of the component to which the ferritic stainless steel sheet is applicable tend to be limited. Especially, in order to meet environmental regulations and complication of component arrangement in accordance with demand for weight reduction, the shape of the components have recently come to be complicated. Further, various measures for reducing forming and welding steps during the production of the components have been studied in order to reduce the cost of the components. In one of the measures studied, a component typically provided by welding is produced in a one-piece component without welding. In the above method, for instance, in contrast to a conventional method in which a steel sheet or a steel pipe is shaped and subsequently welded with other component(s), the steel sheet or steel pipe is subjected to various processing (e.g. deep-drawing, bulge-forming, bending, and tube expansion) for forming the one-piece component.

Some studies have been made in order to overcome the above disadvantages of the ferritic stainless steel sheet or steel pipe in view of formability and processability. For instance, Patent Literature 1 discloses a method of defining a linear pressure during a finish rolling process in a hot rolling process and a method for defining hot-rolled sheet annealing conditions in order to produce components which are difficult to be processed. Patent Literature 2 discloses a method in which X-ray integral intensity ratio and temperature and rolling reduction during a rough rolling in a hot rolling process are defined and an intermediate annealing is applied in addition to annealing of hot-rolled sheet.

Patent Literatures 3 to 6 disclose methods in which r-value or breaking elongation is defined. In addition, Patent Literatures 7 and 8 disclose techniques for defining hot rolling conditions. Specifically, Patent Literatures 7 and 8 disclose that a rolling reduction in a final pass of rough rolling during hot rolling is set at 40% or more, or the rolling reduction in at least one pass is set at 30% or more.

Further, Patent Literature 9 discloses a technique in which texture ({111}<112>, {411}<148>) in sheet-thickness central area of ferritic stainless steel containing 0.5% or more of Mo is controlled to obtain a high r-value steel material. Patent Literature 10 discloses a technique in which intermediate annealing texture of the ferritic stainless steel containing 0.5% or more of Mo is controlled without subjecting the ferritic stainless steel to annealing of hot-rolled sheet, thereby obtaining a high r-value steel material.

Patent Literatures 11 to 12 disclose a ferritic stainless steel whose formability is enhanced by reducing carbon and adjusting the components. However, the formability obtained by the disclosures of the above Patent Literatures is short for 2D pipe expansion and thus is insufficient.

Patent Literature 13 discloses that formability is enhanced by conditioning an annealing temperature, annealing time, rolling ratio and the like during a hot rolling process. In the above arrangement, the r-value is approximately 1.6 at the maximum.

Patent Literature 14 discloses that formability is enhanced by performing annealing of hot-rolled sheet. In the above arrangement, it is supposed that the steel sheet is 0.8 mm thick. Further, the r-value is at most approximately 1.8.

Patent Literature 15 discloses a steel pipe subjected to a two-stage annealing to exhibit more than 100% of tube expansion rate. In the above arrangement, it is supposed that the r-value is approximately 1.6 and the thickness of the material is 0.8 mm.

Patent Literature 16 discloses a ferritic stainless steel in which Si and Mn contents are reduced to improve elongation and Mg is contained to reduce grain size of solidified texture to reduce roping and ridging of the product. However, Patent Literature 16 discloses both instances where the annealing of hot-rolled sheet is performed and where the annealing of hot-rolled sheet is not performed, and does not disclose any hot rolling conditions for the instance where the annealing of hot-rolled sheet is not performed.

Patent Literature 17 discloses a ferritic stainless steel sheet with less surface roughness due to working and excellent formability. In Patent Literature 17, the contents of Si and Mn are reduced in order to restrain reduction in elongation. Further, the finish hot rolling temperature and coiling temperature are lowered to reduce the surface roughness due to working and cold rolling process is performed in two stages by omitting the annealing of hot-rolled sheet to control the texture.

CITATION LIST

Patent Literature(s)

| | |
|---|---|
| Patent Literature 1 | JP 2002-363712 A |
| Patent Literature 2 | JP 2002-285300 A |
| Patent Literature 3 | JP 2002-363711 A |
| Patent Literature 4 | JP 2002-97552 A |
| Patent Literature 5 | JP 2002-60973 A |

-continued

| | |
|---|---|
| Patent Literature 6 | JP 2002-60972 A |
| Patent Literature 7 | JP 4590719 B2 |
| Patent Literature 8 | JP 4065579 B2 |
| Patent Literature 9 | JP 4624808 B2 |
| Patent Literature 10 | JP 4397772 B2 |
| Patent Literature 11 | JP 2012-112020 A |
| Patent Literature 12 | JP 2005-314740 A |
| Patent Literature 13 | JP 2005-325377 A |
| Patent Literature 14 | JP 2009-299116 A |
| Patent Literature 15 | JP 2006-274419 A |
| Patent Literature 16 | JP 2004-002974 A |
| Patent Literature 17 | JP 2008-208412 A |

SUMMARY OF THE INVENTION

Problem(s) to be Solved by the Invention

A first object of the invention is to solve problems of the related art and to efficiently manufacture a ferritic stainless steel sheet and steel pipe having excellent formability that are especially suitable for automobile exhaust components.

The inventors of the present application have found the following problems in the related arts.

The method for enhancing r-value disclosed in Patent Literature 2 is effective for a product having approximately 0.8 mm thickness and capable of providing relatively large cold rolling reduction, but is not sufficient for a thick product having thickness of more than 1 mm. It is supposed that this is because, when an annealing of hot-rolled sheet is applied, the grain size is coarsened and grain size reduction effect of the texture of pre-cold-rolling cannot be exhibited. Further, efficient manufacture of a steel sheet cannot be achieved by these manufacturing methods.

The methods disclosed in Patent Literatures 3 to 6 only increases the r-value and may cause cracks during processing. Specifically, the cracks are likely to occur due to surface irregularities called ridging generated during the processing. Herein, an instance with low level of ridging will be sometimes referred to as "having good ridging characteristics."

The technique for defining the hot rolling conditions disclosed in Patent Literatures 7 and 8 cannot sufficiently restrain surface flaws and ridging.

It has been found that the technique for setting the rough rolling reduction and finish rolling reduction during hot rolling at 0.8 to 1.0 disclosed in Patent Literature 9 deteriorates the ridging characteristics due to growth of {411}<148>-orientated grains and, especially, satisfactory formability after the product is formed into a steel pipe cannot be obtained.

In the technique for controlling the texture during intermediate annealing by omitting the annealing of hot-rolled sheet disclosed in Patent Literature 10, since the intermediate annealing is applied at a relatively low temperature, the hot rolling texture is not sufficiently modified and ridging may occur on the product sheet. Further, it is supposed that a thin sheet with less than 1 mm thickness is processed by the method and, since a high cold rolling reduction cannot be ensured for a steel sheet with relatively large thickness of more than 1 mm, the solution disclosed in Patent Literature 10 is insufficient.

A second object of the invention is to solve disadvantages of the related art and to provide a ferritic stainless steel sheet and steel pipe having excellent formability. An efficient manufacture is also a problem. When the disclosures of the related arts are applied, a steel sheet and a steel pipe having formability sufficient to provide a steel pipe made of a relatively thick steel sheet having more than 1 mm thickness and capable of enduring 2D pipe expansion processing (a processing expanding an end diameter D of the pipe to 2D (i.e. double the diameter)) cannot be provided.

Means for Solving the Problem(s)

In order to solve achieve the above first object, the inventors have performed detailed study on the formability of a ferritic stainless steel sheet and a ferritic stainless steel pipe made from the ferritic stainless steel sheet in view of the steel composition, textures during the production process of the steel sheet and crystal orientation. As a result, it is found that, when the ferritic stainless steel sheet is subjected to extremely severe forming process applied for forming a one-piece exhaust component with a complicated shape, it is possible to significantly improve the freedom of formation by controlling a difference in the crystal orientations in a sheet-thickness center layer of the ferritic stainless steel sheet to apply an excellent r-value and ridging characteristics.

A summary of the invention capable of achieving the above first object is as follows.

(1) A ferritic stainless steel sheet with excellent formability, including: 0.001 to 0.03 mass % of C; 0.01 to 0.9 mass % of Si; 0.01 to 1.0 mass % of Mn; 0.01 to 0.05 mass % of P; 0.0003 to 0.01 mass % of S; 10 to 20 mass % of Cr, 0.001 to 0.03 mass % of N; 0.05 to 1.0 mass % of one or both of Ti and Nb; and a residual amount of Fe and inevitable impurities, in which {111}-orientation intensity of a portion in a vicinity of a sheet-thickness central portion is 5 or more and {411}-orientation intensity of the portion in the vicinity of the sheet-thickness central portion is less than 3.

(2) The ferritic stainless steel sheet with excellent formability according to the above aspect of the invention, in which a Cr content in the ferritic stainless steel sheet is 10.5 mass % or more and less than 14 mass %.

(3) The ferritic stainless steel sheet with excellent formability according to the above aspect of the invention, further including one or more of elements selected from the group consisting of: 0.0002 to 0.0030 mass % of B; 0.005 to 0.3 mass % of Al, 0.1 to 1.0 mass % of Ni, 2.0 mass % or less of Mo, 0.1 to 3.0 mass % of Cu, 0.05 to 1.0 mass % of V, 0.0002 to 0.0030 mass % of Ca, 0.0002 to 0.0030 mass % of Mg, 0.01 to 0.3 mass % of Zr, 0.01 to 3.0 mass % of W, 0.01 to 0.3 mass % of Co, 0.003 to 0.50 mass % of Sn, 0.005 to 0.50 mass % of Sb, 0.001 to 0.20 mass % of REM, 0.0002 to 0.3 mass % of Ga, 0.001 to 1.0 mass % of Ta, and 0.001 to 1.0 mass % of Hf.

(4) The ferritic stainless steel sheet with excellent formability according to the above aspect of the invention, in which a Mo content in the ferritic stainless steel sheet is less than 0.5 mass %.

(5) The ferritic stainless steel sheet with excellent formability according to the above aspect of the invention, in which a grain size number is 5.5 or more.

(6) A manufacturing method of a ferritic stainless steel sheet with excellent formability, the method including: hot-rolling a stainless steel slab of a composition according to the above aspect of the invention at a slab heating temperature in a range from 1100 to 1200 degrees C., the hot-rolling being a continuous rolling including rough rolling steps performed for (n) pass numbers and a finish rolling, at least (n−2) numbers of the rough rolling steps being performed under a 30% or more of rolling reduction and at a rough rolling end temperature of 1000 degrees C. or more, finishing temperature of the finish rolling being 900 degrees C. or less; winding the stainless steel slab at a temperature of 700 degrees C. or less; and without performing a annealing of hot-rolled sheet, subjecting the stainless steel slab to: intermediate cold rolling in which the stainless steel slab is cold-rolled at least once using a roller with a diameter of 400 mm or more and at a rolling reduction of 40% or more; intermediate annealing in which the stainless steel slab is heated at a temperature in a range from 820 to 880 degrees C.; finish cold rolling; and finish annealing in which the stainless steel slab is heated at a temperature in a range from 880 to 950 degrees C.

(7) The manufacturing method of ferritic stainless steel sheet with excellent formability according to the above aspect of the invention, in which, in the intermediate annealing, a grain size number is made to be 6 or more and a {111}-orientation intensity at a portion in the vicinity of the sheet-thickness center layer is made to be 3 or more.

(8) The manufacturing method of ferritic stainless steel sheet with excellent formability according to the above aspect of the invention, in which, in the final annealing, a grain size number is made to be 5.5 or more.

(9) A ferritic stainless steel pipe with excellent formability, in which the ferritic stainless steel pipe is made from a material in a form of the stainless steel sheet according to the above aspect of the invention.

(10) A ferritic stainless steel sheet for an automobile exhaust component, in which the ferritic stainless steel sheet for an automobile exhaust component is made from a material in a form of the stainless steel sheet according to the above aspect of the invention.

As is clear from the above description, a ferritic stainless steel sheet with excellent formability can be efficiently provided without introducing new equipment according to the above aspect of the invention.

According to the above aspect of the invention, it is possible to provide a ferritic stainless steel sheet with excellent r-value and ridging characteristics. With the use of the material embodying the above aspect of the invention, especially for components of automobiles and motorcycles, the freedom of formation improves and integral molding without requiring welding between components is possible, thereby enabling efficient production of the components. In other words, the invention is industrially extremely useful.

A summary of the invention capable of achieving the above second object is as follows.

(11) A ferritic stainless steel sheet with excellent formability, including: 0.03 mass % or less of C; 0.03 mass % or less of N; 1.0 mass % or less of Si; 3.0 mass % or less of Mn; 0.04 mass % or less of P; 0.0003 to 0.0100 mass % of S; 10 to 30 mass % of Cr, 0.300 mass % or less of Al; one or both of 0.05 to 0.30 mass % of Ti and 0.01 to 0.50 mass % of Nb, a sum of Ti and Nb being in a range from smaller one of 8(C+N) and 0.05 to 0.75 mass % and a residual amount of Fe and inevitable impurities, in which {111}<110>-orientation intensity is 4.0 or more and {311}<136>-orientation intensity is less than 3.0.

(12) The ferritic stainless steel sheet with excellent formability according to the above aspect of the invention, further including one or more of elements selected from the group consisting of: 0.0002 to 0.0030 mass % of B, 0.1 to 1.0 mass % of Ni, 0.1 to 2.0 mass % of Mo, 0.1 to 3.0 mass % of Cu, 0.05 to 1.00 mass % of V, 0.0002 to 0.0030 mass % of Ca, 0.0002 to 0.0030 mass % of Mg, 0.005 to 0.500 mass % of Sn, 0.01 to 0.30 mass % of Zr, 0.01 to 3.0 mass % of W, 0.01 to 0.30 mass % of Co, 0.005 to 0.500 mass % of Sb, 0.001 to 0.200 mass % of REM, 0.0002 to 0.3 mass % of Ga, 0.001 to 1.0 mass % of Ta, and 0.001 to 1.0 mass % of Hf.

(13) The ferritic stainless steel sheet with excellent formability according to the above aspect of the invention, in which a grain size number is 6 or more.

(14) The ferritic stainless steel sheet with excellent formability according to the above aspect of the invention, in which, when a sheet thickness is represented by t (mm) and an average r-value is represented by $r_m$, $r_m$ satisfies a relationship of $rm \geq -1.0t+3.0$.

(15) The ferritic stainless steel sheet with excellent formability according to the above aspect of the invention, in which the ferritic stainless steel pipe is suitable for use in an automobile component or a motorcycle component.

(16) The ferritic stainless steel sheet with excellent formability according to the above aspect of the invention, in which the ferritic stainless steel pipe is suitable for use in an automobile exhaust pipe, fuel tank or a fuel pipe.

(17) A manufacturing method of a ferritic stainless steel sheet with excellent formability, the method including: hot-rolling a stainless steel slab of a composition according to the above aspect of the invention, the hot-rolling including rough rolling and finish rolling, the rough rolling being performed at a slab heating temperature in a range from 1100 to 1200 degrees C., the finish rolling being performed at a start temperature of 900 degrees C. or more and an end temperature of 800 degrees C. or more so that a difference between the start temperature and the end temperature is 200 degrees C. or less; winding the stainless steel slab at a temperature of 600 degrees C. or more; and subsequently subjecting the stainless steel slab to intermediate cold rolling, intermediate annealing, finish cold rolling, and finish annealing without applying annealing of hot-rolled sheet, in which the cold rolling is at least once performed at 40% or more of rolling reduction using a roller having a diameter of 400 mm or more, the stainless steel slab is heated to a temperature in a range from 800 to 880 degrees C. in the intermediate annealing, the stainless steel slab is cold-rolled in the finish cold rolling at a rolling reduction of 60% or more, and in the final annealing, the stainless steel slab is heated to a temperature in a range from 850 to 950 degrees C.

(18) The manufacturing method of ferritic stainless steel sheet with excellent formability according to the above aspect of the invention, in which a texture immediately before completion of recrystallization or a minute texture of a grain size number of 6 or more is obtained in the intermediate annealing.

(19) A ferritic stainless steel pipe with excellent formability, in which the ferritic stainless steel pipe is made from a material in a form of the stainless steel sheet according to the above aspect of the invention.

According to the above aspect of the invention, a ferritic stainless steel sheet with excellent formability can be efficiently provided without introducing new equipment. The ferritic stainless steel sheet of the above aspect of the invention can endure 2D pipe expansion even when the ferritic stainless steel sheet having relatively large thickness (e.g. more than 1 mm) is made into a steel pipe.

According to the above aspect of the invention, it is possible to provide a ferritic stainless steel sheet with excellent r-value. With the use of the material embodying the above aspect of the invention, especially for components of automobiles and motorcycles (e.g. an exhaust pipe such as muffler and exhaust manifold, a fuel tank and fuel pipe), the freedom of formation improves and integral molding without requiring welding between components is possible, thereby enabling efficient production of the components. In other words, the invention is industrially extremely useful.

BRIEF DESCRIPTION OF DRAWING(S)

DESCRIPTION OF EMBODIMENT(S)

Figure 1:
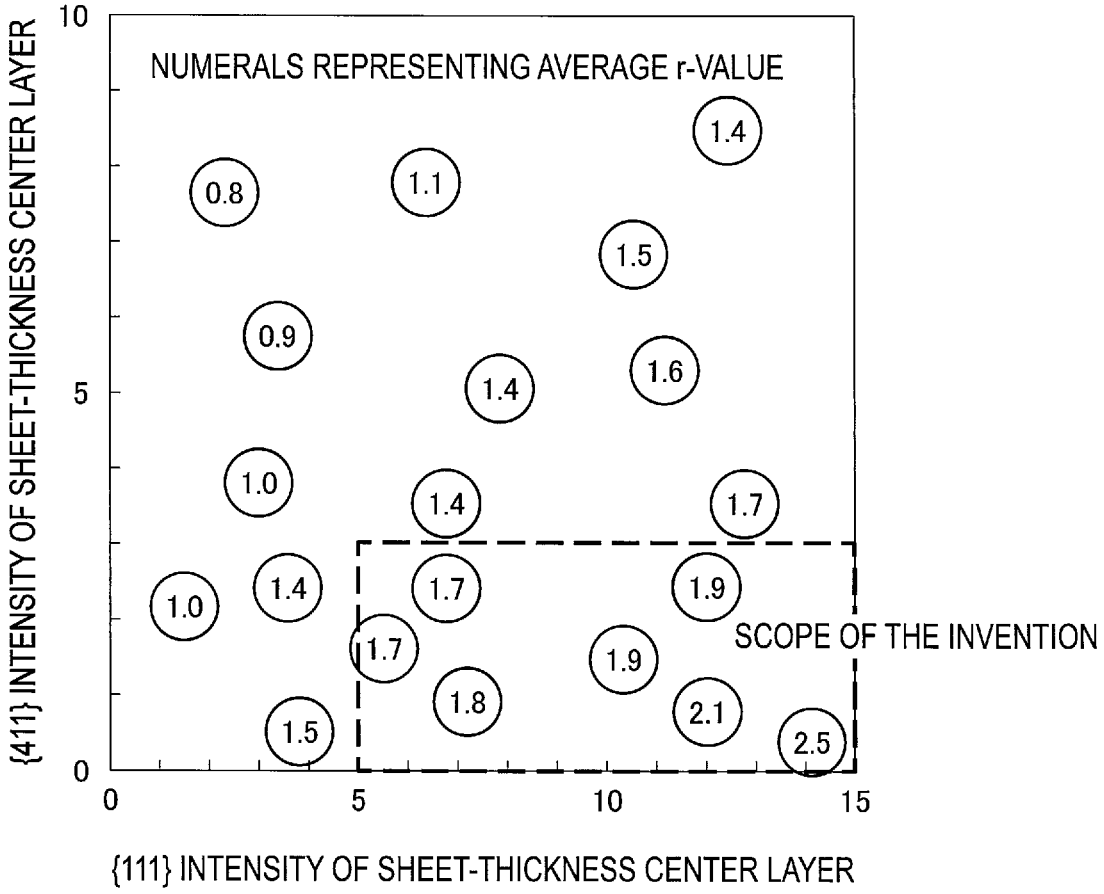
FIG. 1 illustrates a relationship between an average r-value, and {111}-orientation intensity and {411}-orientation intensity of a product sheet.

A first exemplary embodiment adapted to achieve the above-described first object will be described below.

The invention is defined for the following reasons. Indexes of formability of ferritic stainless steel sheet include an r-value (index for deep drawability), a total elongation (index for bulging formability) and ridging (surface flaw caused after press forming). Among the above, the r-value and ridging are primarily dependent on crystal orientation of the steel, whereas the total elongation is primarily dependent on the composition of the steel. The formable size increases as these properties get better. The r-value increases as more {111}-crystal orientations (i.e. crystal grains having {111} crystal face parallel to a sheet face of the steel sheet in a body-centered cubic crystal structure) are present. In the exemplary embodiment, it is found that the r-value cannot be determined based solely on the {111}-crystal orientation but is also dependent on {411}-crystal orientation. On the other hand, ridging is formed on the surface of the steel sheet in a form of irregularities due to difference in plastic deformability between the colonies when colonies of crystal grains having different crystal orientations are stretched in a rolling direction. In general, it is supposed that the reduction of colonies of the {100}-crystal orientation and {111}-crystal orientation is effective for preventing ridging. Since the {111}-crystal orientation improves the r-value, it is conventionally suggested that the improvement in the r-value and the reduction in the ridging cannot be simultaneously achieved. In order to achieve both of the above, microstructural studies on the texture formation, development of the r-value, and generation mechanism of the ridging have been made in detail. Consequently, it is found in the invention that {411}-crystal orientation has more to do with the characteristics of ridging of the ferritic stainless steel sheet than the {100}-crystal orientation. Thus, it is found that a ferritic stainless steel sheet that is excellent in the r-value and ridging characteristics and has extremely excellent formability, and a steel pipe made of the ferritic stainless steel sheet can be provided. Specifically, it is defined in the invention that {111}-orientation intensity is 5 or more and {411}-orientation intensity is less than 3 in the vicinity of a sheet-thickness central portion, thereby providing a ferritic stainless steel sheet excellent in both of the r-value and ridging characteristics and providing excellent formability.

Herein, the {111}-orientation intensity and {411}-orientation intensity in the vicinity of the sheet-thickness central portion can be measured by: obtaining (200), (110) and (211) pole figures of the sheet-thickness central area using an X-ray diffractometer and Mo-Kα ray, and obtaining three-dimensional crystallographic orientation distribution function based on the dot diagrams using a spherical harmonics method. The portion in the vicinity of the sheet-thickness central portion specifically refers to an area 0.2 mm with respect to the sheet-thickness center in view of the accuracy in collecting a sample.

Figure 2:
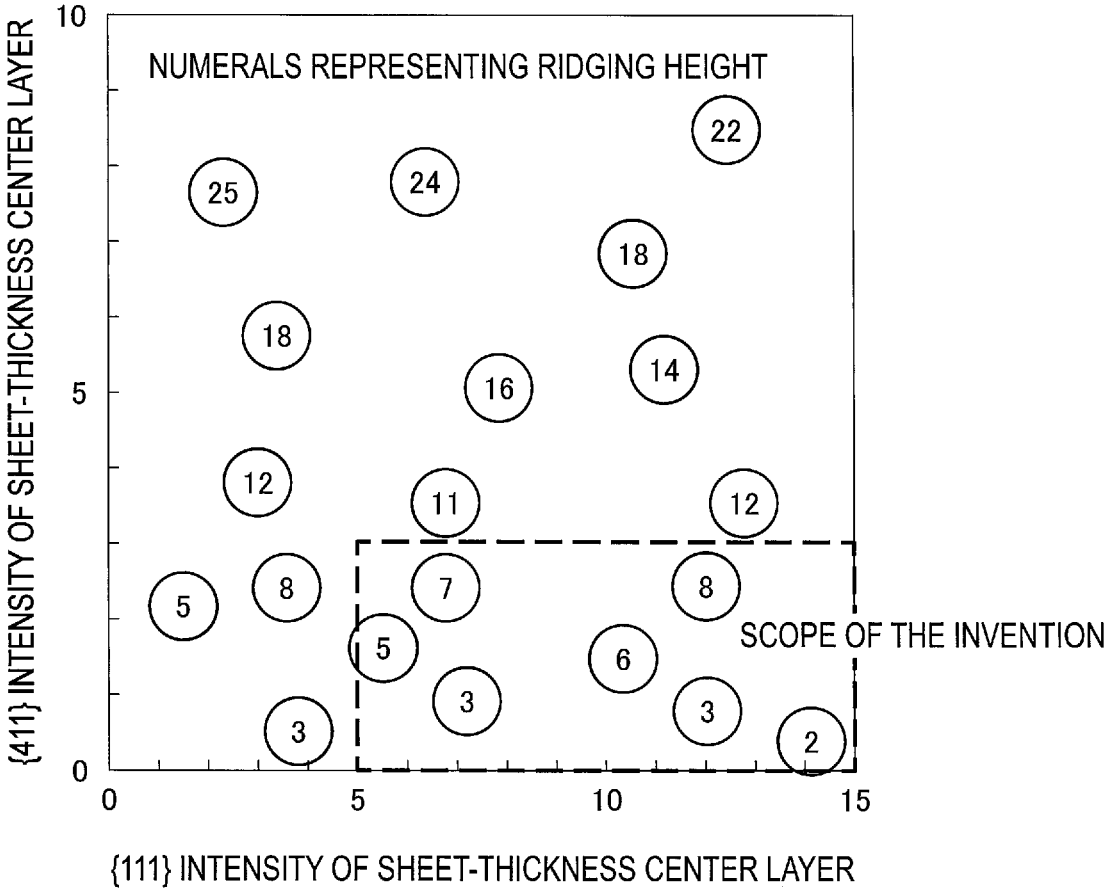
FIG. 2 illustrates a relationship between a ridging height, and the {111}-orientation intensity and the {411}-orientation intensity of the product sheet.

A cold rolled steel sheet of 1.2 mm thickness was made from a ferritic stainless steel sheet containing 0.004% of C, 0.42% of Si, 0.32% of Mn, 0.02% of P, 0.0005% of S, 10.7% of Cr, 0.16% of Ti and 0.007% of N. Results of examination on the relationship between a texture, r-value and ridging characteristics on the prepared ferritic stainless steel sheet are shown in FIGS. 1 and 2. Herein, in order to evaluate the texture, (200), (110) and (211) pole figures of the sheet-thickness central area (exposing the central area by a combination of mechanical polishing and electropolishing) are obtained using an X-ray diffractometer (manufactured by Rigaku Corporation) and Mo-Kα ray to obtain a three-dimensional crystallographic orientation distribution function based on the dot diagrams using a spherical harmonics method. In order to evaluate the r-value, JIS13B tensile test pieces were taken from a cold rolled annealing sheet and an average r-value was calculated using formulae (1) and (2) below after applying 15% distortions in a rolling direction, 45-degree direction with respect to the rolling direction and a direction perpendicular to the rolling direction.

$$r=\ln(W_0/W)/\ln(t_0/t) \quad (1)$$

In the formula (1), $W_0$ represents a sheet width before applying a tensile force, W represents a sheet width after applying the tensile force, $t_0$ represents a sheet thickness before applying the tensile force and t represents a sheet thickness after applying the tensile force.

$$\text{Average } r\text{-value}=(r_0+2r_{45}+r_{90})/4 \quad (2)$$

In the formula (2), $r_0$ represents an r-value in the rolling direction, $r_{45}$ represents an r-value in 45-degree direction with respect to the rolling direction and $r_{90}$ represents an r-value in a direction perpendicular to the rolling direction. The higher average r-value represents more excellent deep drawability of the steel sheet, and more excellent bendability and pipe expansivity of the steel pipe. In order to evaluate the ridging, JISS tensile test pieces were taken from a cold rolled annealing sheet and 16% distortion was applied on the test pieces in the rolling direction. Subsequently heights of irregularities caused on the surface of the steel sheet were measured using a two-dimensional roughness gauge to obtain a ridging height. The lower ridging height indicates more excellent ridging characteristics. As described above, an object of the invention is to provide a ferritic stainless steel sheet and a steel pipe having extremely excellent formability. The parameters of average r-value of 1.7 or more and ridging height of less than 10 μm suggest a material capable of being subjected to severe processing.

As shown in FIGS. 1 and 2, the average r-value becomes 1.7 or more when the {111}-orientation intensity is 5 or more. The ridging height becomes less than 10 μm when the {411}-orientation intensity is less than 3. Accordingly, the scope of an aspect of the invention is defined as {111}-orientation intensity of 5 or more and {411}-orientation intensity of less than 3. Though the r-value increases in accordance with an increase in the {111}-orientation intensity, {411}-crystal orientation lowers the r-value. Further, since the {411}-crystal orientation is low in the r-value as compared to {111}-crystal orientation, a large sheet thickness reduction occurs when the sheet is deformed, so that dents of the ridging is likely to be formed. In the above aspect of the invention, in addition to the conventionally-known increase in the r-value by increasing the {111}-crystal orientation, it is newly found that the r-value can be increased and the ridging can be reduced by reducing the {411}-crystal orientation. The plots having respective [{111}-orientation intensity, and {411}-orientation intensity] of [6.7, 2.4] and [11.9, 2.4] in FIGS. 1 and 2 are favorable in both of the average r-value and ridging height.

Next, a composition of the steel will be described below. In the description of the composition, % refers to mass %.

C deteriorates formability and corrosion resistance. Especially, the growth in the {111}-crystal orientation is greatly affected by solid solution C, where, when more than 0.03% C is added, the {111}-orientation intensity does not reach 5. Accordingly, the upper limit of the C content is defined at 0.03%. However, excessive reduction in the C content results in increase in refining cost. Accordingly, the lower limit of the C content is defined at 0.001%. In addition, the C content is preferably 0.002% or more in view of the production cost. The C content is preferably 0.01% or less in view of boundary corrosivity at a welded part.

Si is sometimes added as deoxidizing element. In addition, Si improves oxidation resistance. However, since Si is a solid solution strengthening element, the Si content is preferably as small as possible in order to ensure total elongation. Further, much amount of added Si causes change in a slip system to promote the growth in the {411}-crystal orientation and restrain the {111}-crystal orientation. Accordingly, the upper limit of the Si content is defined at 0.9%. On the other hand, in order to ensure oxidation resistance, the lower limit of the Si content is defined at 0.01%. However, in view of the fact that excessive reduction in the content of Si results in increase in refining cost and also in view of weldability, the Si content is preferably 0.2% or more. For similar reasons, Si content is preferably 0.5% or less.

Since Mn is a solid solution strengthening element similarly to Si, the Mn content in the material is preferably as small as possible. However, the upper limit of the Mn content is defined at 1.0% in view of oxidation peelability. On the other hand, excessive reduction in the Mn content results in increase in refining cost. Accordingly, the lower limit of the Mn content is defined at 0.01%. In addition, the Mn content is preferably 0.5% or less in view of the material. The Mn content is preferably 0.1% or more in view of the production cost.

Since P is a solid solution strengthening element similarly to Mn and Si, the P content in the material is preferably as small as possible. Further, much amount of added P causes change in a slip system to promote the growth in the {411}-crystal orientation. Accordingly, the upper limit of the P content is defined at 0.05%. However, excessive reduction in the P content results in increase in the material cost. Accordingly, the lower limit of the P content is defined at 0.01%. In addition, the P content is preferably 0.02% or less in view of the production cost and corrosion resistance.

S forms $Ti_4C_2S_2$ in Ti-containing steel at a high temperature to contribute to the growth in the texture effective for improving the r-value. The formation of $Ti_4C_2S_2$ is exhibited when S is contained at an amount of 0.0003% or more. Accordingly, the lower limit of the S content is defined at 0.0003%. However, when S is added at an amount of more than 0.01%, {411}-crystal orientation grows so that the intensity in the {411}-crystal orientation exceeds 3 and corrosion resistance deteriorates. Accordingly, the upper limit of the S content is defined at 0.01%. In addition, the S content is preferably 0.0005% or more in view of the refining cost. The S content is preferably 0.0060% or less in view of boundary corrosivity in produced components.

Cr is an element that improves corrosion resistance and oxidation resistance. In view of environment in which exhaust components are provided, 10% or more of Cr is necessary in order to restrain abnormal oxidation. The Cr content is preferably 10.5% or more. On the other hand, excessive addition of Cr hardens the steel to deteriorate the formability, restrains the growth of the {111}-oriented grains and promotes the growth of the {411}-oriented grains. Further, in fear of increase in the production cost, the upper limit of the Cr content is defined at 20%. It should be noted that, in view of the production cost, sheet breakage due to deterioration in toughness during production of the steel sheet and formability, the upper limit of the Cr content is preferably less than 14%.

Similarly to C, N deteriorates formability and corrosion resistance. In addition, the growth in the {111}-crystal orientation is greatly affected by solid solution C, where, when more than 0.03% N is added, the {111}-orientation intensity does not reach 5. Accordingly, the upper limit of the N content is defined at 0.03%. However, excessive reduction in the N content results in increase in refining cost. Accordingly, the lower limit of the N content is defined at 0.001%. In addition, the N content is preferably 0.005% or more in view of the production cost. The N content is preferably 0.015% or less in view of formability and corrosion resistance.

In the exemplary embodiment, 0.05 to 1.0% of one or more of Ti and Nb is contained.

Ti is an element added to be bonded to C, N and S to improve the corrosion resistance, intercrystalline corrosion resistance and deep drawability. The function for fixing C and/or N is exhibited at Ti content of 0.05% or more. Accordingly, lower limit of the Ti content is defined at 0.05%. The Ti content is preferably 0.06% or more. Further, when more than 1.0% of Ti is added, the product is hardened due to solid solution Ti to cause the growth of the {411}-orientated grains and deterioration of toughness. Accordingly, the upper limit of the Ti content is defined at 1.0%. Further, the Ti content is preferably 0.25% or less in view of the production cost.

Nb is added as necessary because Nb is effective for improvement in formability and high-temperature strength due to the growth in the {111}-oriented grains and for inhibition of crevice corrosion and promotion of repassivation. The function due to the addition of Nb is exhibited at Nb content of 0.05% or more. Accordingly, the lower limit of the Nb content is defined at 0.05%. However, when more than 1.0% of Nb is added, the {411}-orientation intensity becomes more than 3 on account of coarse Nb (C,N) and hardening also occurs. Accordingly, the upper limit of the Nb content is defined at 1.0%. It should be noted that the Nb content is preferably 0.55% or less in view of the material cost.

The stainless steel sheet according to the exemplary embodiment may further optionally contain the following elements.

B is an element that enhances secondary formability by segregation at grain boundaries. In order to restrain vertical crack of an exhaust pipe when the exhaust pipe is subjected to a secondary processing, especially in winter, 0.0002% or more of B has to be added. The B content is preferably 0.0003% or more. However, addition of excessive addition of the B content restrains the growth of the {111}-oriented grains and reduces formability and corrosion resistance. Accordingly, the upper limit of the B content is defined at 0.0030%. In addition, the B content is preferably 0.0015% or less in view of the refining cost and decrease in ductility.

Al is added as a deoxidizing element and, in addition, is adapted to restrain oxide scales from being peeled off. Since the function of Al is exhibited at an amount of 0.005% or more, the lower limit of the Al content is defined at 0.005%. On the other hand, addition of 0.3% or more of Al results in less than 5 of the {111}-orientation intensity due to precipitation of coarse AlN and also causes reduction in elongation and deterioration in weld compatibility and surface quality. Accordingly, the upper limit of the Al content is defined at 0.3%. Further, the Al content is preferably 0.15% or less in view of the refining cost. The Al content is preferably 0.01% or more in view of pickling capability during production of the steel sheet.

Ni is added as necessary in order to restrain crevice corrosion and promote repassivation. The function due to the addition of Ni is exhibited at the Ni content of 0.1% or more. Accordingly, the lower limit of the Ni content is defined at 0.1%. The Ni content is preferably 0.2% or more. However, when the Ni content exceeds 1.0%, a change in the slip system occurs to grow the {411}-crystal orientation, so that the {411}-orientation intensity exceeds 3. Further, when the Ni content exceeds 1.0%, hardening and stress corrosion crack are likely to occur. Accordingly, the upper limit of the Ni content is defined at 1.0%. It should be noted that the Ni content is preferably 0.8% or less in view of the material cost.

Mo is an element that improves corrosion resistance, which, especially when there is a crevice structure, restrains crevice corrosion. When the Mo content exceeds 2.0%, significant deterioration in formability and productivity occurs. Accordingly, the upper limit of the Mo content is defined at 2.0%. Further, in order to restrain the growth of the {411}-oriented grains and to sharply grow the {111}-orientated grains, and in view of alloy cost and productivity, the Mo content is preferably less than 0.5%. The above effects of the Mo content is exhibited at Mo content of 0.01% or more. Accordingly, the lower limit of the Mo content is preferably defined at 0.01%. The lower limit of the Mo content content is further preferably defined at 0.1%.

Cu is added as necessary in order to restrain crevice corrosion and promote repassivation. The function due to the addition of Cu is exhibited at Cu content of 0.1% or more. Accordingly, the lower limit of the Cu content is defined at 0.1%. The C content is preferably 0.3% or more. However, addition of excessive amount of Cu causes hardening of the steel and restrains the growth of the {111}-oriented grains to reduce formability. Accordingly, the upper limit is defined at 3.0%. It should be noted that the Cu content is preferably 1.5% or less in view of the productivity.

V is added as necessary in order to restrain crevice corrosion. The function due to the addition of V is exhibited at V content of 0.05% or more. Accordingly, the lower limit of the V content is defined at 0.05%. The V content is preferably 0.1% or more. However, when more than 1.0% of V is added, the {111}-orientation intensity does not reach 5 on account of formation of coarse VN and hardening also occurs to deteriorate formability. Accordingly, the upper limit of the V content is defined at 1.0%. It should be noted that the V content is preferably 0.5% or less in view of the material cost.

Ca is added as necessary for desulfurization. The function due to the addition of Ca is not exhibited at Ca content of less than 0.0002%. Accordingly, the lower limit of the Ca content is defined at 0.0002%. On the other hand, water-soluble inclusion in a form of CaS is generated when more than 0.0030% of Ca is added to restrain the growth in the {111}-crystal orientation and promote growth in the {411}-orientation, thereby reducing the r-value. Further, in order not to considerably reduce the corrosion resistance, the upper limit of the Ca content is defined at 0.0030%. In addition, the C content is preferably 0.0015% or less in view of surface quality.

Mg is sometimes added as deoxidizing element. Further, Mg is an element that miniaturizes slab structure to contribute to growth of texture that enhances formability. The function due to the addition of Mg is exhibited at the Mg content of 0.0002% or more. Accordingly, the lower limit of the Mg content is defined at 0.0002%. The Mg content is preferably 0.0003% or more. However, when more than 0.0030% of Mg is added, the {111}-orientation intensity does not reach 5 on account of formation of coarse MgO and weldability and corrosion resistance deteriorate. Accordingly, the upper limit of the Mg content is defined at 0.0030%. The Mg content is preferably 0.0010% or more in view of the refining cost.

0.01% or more of Zr is added as necessary because Zr is bonded with C or N to promote the growth of the texture. However, when more than 0.3% of Zr is added, coarse ZrN is generated to inhibit the {111}-orientation intensity from reaching 5, production cost increases and productivity considerably deteriorates. Accordingly, the upper limit of the Zr content is defined at 0.3%. The Zr content is preferably 0.1% or less in view of the refining cost and productivity.

W is an element that contributes to improvement in corrosion resistance and high-temperature strength. Accordingly, 0.01% or more of W is added as necessary. However, when more than 3.0% of W is added, the {111}-orientation intensity does not reach 5 on account of formation of coarse WC, toughness deteriorate during the production of steel sheet and the production cost is increased. Accordingly, the upper limit of the W content is defined at 3.0%. The W content is preferably 2.0% or less in view of the refining cost and productivity.

Co is an element that contributes to improvement in high-temperature strength. Accordingly, 0.01% or more of Co is added as necessary. However, when more than 0.3% of Co is added, the {111}-orientation intensity does not reach 5 on account of formation of coarse $CoS_2$ and deterioration in toughness during the production of steel sheet and increase in the production cost are caused. Accordingly, the upper limit of the Co content is defined at 0.3%. The Co content is preferably 0.1% or less in view of the refining cost and productivity.

Sn is an element that contributes to improvement in corrosion resistance and high-temperature strength. Accordingly, 0.003% or more of Sn is added as necessary. The Sn content is preferably 0.005% or more. However, when more than 0.50% of Sn is added, the {111}-orientation intensity does not reach 5 on account of prominent segregation of Sn at grain boundaries and the slab may be cracked during the production of steel sheet. Accordingly, the upper limit of the Sn content is defined at 0.50%. The Sn content is preferably 0.30% or less in view of the refining cost and productivity. Further, the Sn content is preferably 0.15% or less.

Sb is an element that enhances high-temperature strength by segregation at grain boundaries. In order to achieve the effect of addition, the amount of added Sb is 0.005% or more. However, when more than 0.50% of Sb is added, the {111}-orientation intensity does not reach 5 on account of prominent segregation of Sb at grain boundaries and cracks may be caused during welding process. Accordingly, the upper limit of the Sb content is defined at 0.50%. The Sb content is preferably 0.03% or more in view of high-temperature characteristics. The Sb content is more preferably 0.05% or more. The Sb content is preferably 0.30% or less in view of the production cost and toughness. The Sb content is more preferably 0.20% or less.

REM (Rare Earth Metal) is a group of elements that contributes to improvement in oxidation resistance. Accordingly, 0.001% or more of REM is added as necessary. The lower limit of the REM content is preferably defined at 0.002%. Even when more than 0.20% of REM is added, the effect of the addition of REM is saturated and the growth in the {111}-crystal orientation is restrained due to formation of coarse oxide. Further, corrosion resistance deteriorates due to REM grains. Accordingly, added amount of REM is in a range from 0.001 to 0.20%. The upper limit of the content of REM is preferably 0.10% in view of formability of the product and production cost. The REM (Rare Earth Metal) refers to those elements according to general definition. Specifically, REM refers to a group of elements consisting of: two elements of scandium (Sc) and yttrium (Y); and fifteen elements (lanthanoid) from lanthanum (La) to lutetium (Lu). REM may be singly added or may be added in a form of a mixture.

0.3% or less of Ga may be added in order to improve corrosion resistance and restrain hydrogen embrittlement. When more than 0.3% of Ga is added, coarse sulfide is generated to restrain the increase in the {111}-orientation intensity and deteriorate the r-value. The lower limit of the Ga content is defined at 0.0002% in view of formation of sulfides and hydrides. In addition, the Ga content is preferably 0.0020% or more in view of the productivity and production cost.

0.001 to 1.0% of Ta and/or Hf may be added in order to improve the high-temperature strength. Further, though the other components are not specifically defined in the exemplary embodiment, 0.001 to 0.02% of Bi may be added as necessary. It should be noted that the content of common detrimental elements (e.g. As and Pb) and impurity elements should be as small as possible.

Next, a manufacturing method will be described below. A manufacturing method of steel sheet of the exemplary embodiment includes steps of steelmaking, hot rolling, pickling, cold rolling and annealing. In the steelmaking, steel containing the above-described essential components and component(s) added as necessary are suitably melted in a converter furnace and subsequently subjected to a secondary smelting. The melted steel is formed into a slab according to known casting process (continuous casting). The slab is heated to a predetermined temperature and is hot-rolled to have a predetermined thickness through a continuous rolling procedure.

In the exemplary embodiment, the slab is subjected to pickling without applying annealing of hot-rolled sheet and is subjected to the cold rolling process as a cold rolling material. The above process is different from a typical procedure (typically, the annealing of hot-rolled sheet is applied). Though the annealing of hot-rolled sheet is applied to obtain a granulated recrystallization texture in the typical procedure, it is difficult in the typical procedure to significantly reduce the size of the crystal grains before the cold rolling. It is found in the exemplary embodiment that when the size of the crystal grains before the cold rolling is large, grain boundary area reduces so that the {111}-crystal orientation improving the r-value does not grow in a product sheet but the {411}-crystal orientation grows, so that the texture should be miniaturized by promoting the recrystallization during the hot rolling process.

The cast slab is heated at 1100 to 1200 degrees C. When the slab is heated at a temperature of more than 1200 degrees C., the crystal grains are coarsened so that the texture is not miniaturized during the hot rolling process. Thus, the {111}-crystal orientation does not grow but the {411}-crystal orientation grows to reduce the r-value. Further, if the temperature is less than 1100 degrees C., since only deformation texture develops without causing recrystallization, the ridging of the product sheet becomes unfavorable. Thus, the slab heating temperature is defined in a range from 1100 to 1200 degrees C. In addition, the heating temperature is preferably 1120 degrees C. or more in view of the productivity and surface flaw. For similar reasons, the heating temperature is preferably 1160 degrees C. or less.

After the slab is heated, a plurality of passes of rough rolling are applied. It is found in the invention that, by applying at least 30% of rolling reduction in at least (n−2) times of rough rolling (total pass number n), recrystallization eminently progresses to miniaturize the texture. This is because the recrystallization progresses in a period from the rough rolling to the finish rolling due to strain during the rough rolling. Since the growth of the {411}-oriented grains occurs in the typically known method of applying a high rolling reduction only in a final pass or defining the rolling reduction ratio between the rough rolling and the finish rolling, the formation of recrystallization orientation contributing both of improvement in the r-value and the reduction of ridging is insufficient. This is because, only by defining rolling reduction ratio between the rough rolling and the finish rolling, the desired orientation intensity cannot be sufficiently controlled under the influence of nucleus generation of the crystal grains and dependency of the crystal grain growth on crystal orientation between passes. In the invention, it is found that recrystallization repeatedly occurs by applying rolling with 30% or more of rolling reduction as much times as possible in the passes of the rough rolling. Accordingly, after the pass number and the action of the recrystallization are studied in detail, it is found that 30% or more of rolling reduction should be applied in (n−2) or more number of the passes of the rough rolling in the invention. Further, since it is difficult to control the recrystallization and grain growth between passes only by defining the rolling reduction in each of passes in the rough rolling, the end temperature of the rough rolling is defined at 1000 degrees C. or more in the invention. This is because, when the end temperature is less than 1000 degrees C., the recrystallization after the rough rolling does not progress but deformation texture mainly in the {411}-crystal orientation remains, whereby the {411}-oriented grains grow in a period between the rough rolling and the finish rolling to exert adverse influence on the r-value and ridging of a product sheet. In the invention, in order to restrain the generation and growth of the {411}-oriented grains in the period between the rough rolling and the finish rolling, the end temperature of the rough rolling is defined at 1000 degrees C. or more.

After the rough rolling, finish rolling is unidirectionally applied using a device including a plurality of stands. In the invention, the finishing temperature is 900 degrees C. or less. After the finish rolling, the product is wound. The coiling temperature is 700 degrees C. or less. In this winding step, recrystallization is not promoted but the deformation texture grows in order to miniaturize the recrystallization texture in the cold rolling and annealing after the hot rolling. Accordingly, the finish rolling temperature is set at 900 degrees C. or less and the coiling temperature is set at 700 degrees C. or less, so that restoration and recrystallization are restrained during this period to intentionally introduce the deformed strain. The finish rolling temperature is preferably 700 degrees C. or more and the coiling temperature is 500 degrees C. or more in view of surface flaw and sheet-thickness accuracy. Similarly, the finish rolling temperature is preferably 850 degrees C. or less and the coiling temperature is 650 degrees C. or less in view of surface flaw and sheet-thickness accuracy. It should be noted that, though partial recrystallization sometimes occurs depending on the composition in this step, the size of the generated recrystallized grains is extremely small and thus is not a problem.

In the exemplary embodiment, the product is subjected to pickling without applying the annealing of hot-rolled sheet and is subjected to the cold rolling process. The above process is different from a typical procedure (typically, the annealing of hot-rolled sheet is applied), which, in combination with the above-described conditions for hot rolling, provides minute recrystallized grains during the cold rolling to achieve both of the improvement in the r-value and the reduction of ridging, In the cold rolling process, intermediate cold rolling, intermediate annealing, finish cold rolling, and finish annealing are performed in this order.

In the intermediate cold rolling, cold rolling is at least once performed at 40% or more of rolling reduction using a roller having a diameter of 400 mm or more. The roll diameter of 400 mm or more restrains shear strains during the cold rolling and also restrains the generation of crystal orientation (e.g. {411}<148>) that reduces the r-value during the subsequent annealing process.

In the intermediate annealing performed in the middle stage of the cold rolling, a recrystallization texture having grain size number of 6 or more is obtained. When the grain size number is less than 6, since the grain size is large, {111}-oriented grains are unlikely to be generated from the grain boundary but the {411}-oriented grains are formed. The grain size number is preferably less than 6.5. Further, it is found in the invention that, in addition to miniaturization of the texture during the production process, it is effective for improvement in the formability of the product to grow the {111}-crystal orientation and restrain the {411}-crystal orientation. Accordingly, the intensity in the {111}-crystal orientation in the intermediate annealing step is set at 3 or more. The {111}-orientation intensity after the intermediate annealing is set at 3 or more in the exemplary embodiment because it is found that {111}-crystal orientation is more frequently generated based on the {111}-oriented grains and the worked grains in the formation of texture during the subsequent finish cold rolling and finish annealing steps. The intensity is preferably 3.5 or more. In order to satisfy the above intensity conditions, the intermediate annealing temperature is set in a range from 820 to 880 degrees C. Though the annealing is applied at a temperature of more than 880 degrees C. in order to grow the size of the recrystallized grains in a typical intermediate annealing, the annealing is applied at a temperature lower than that in the typical intermediate annealing in order to obtain minute textures immediately after the recrystallization in the exemplary embodiment. Since the intermediate annealing temperature of less than 820 degrees C. does not grow the {111}-orientation intensity on account of failure in recrystallization but the {411}-orientation intensity increases, the lower limit of the intermediate annealing temperature is defined at 820 degrees C. On the other hand, when the intermediate annealing temperature exceeds 880 degrees C., the grain growth is already caused and the {411}-crystal grains are preferentially grown. Accordingly, the upper limit of the intermediate annealing temperature is defined at 880 degrees C. In addition, the intermediate annealing temperature is preferably 830 degrees C. or more in view of the productivity and pickling capability. In addition, the intermediate annealing temperature is preferably 875 degrees C. or less in view of the productivity and pickling capability.

The annealing temperature in the finish annealing after the finish cold rolling is set in a range from 880 to 950 degrees C. to adjust the grain size number at 5.5 or more. When the grain size number is less than 5.5, ridging or surface roughness (so-called orange peel) becomes prominent. Accordingly, the upper limit of the grain size number is defined at 5.5. Since the annealing temperature satisfying the above requirement is 950 degrees C. or less, the upper limit of the annealing temperature is defined at 950 degrees C. On the other hand, since the non-recrystallized texture sometimes partially remains when the annealing temperature is less than 880 degrees C., the lower limit of the annealing temperature is defined at 880 degrees C. Further, the annealing temperature is preferably 910 degrees C. or less and the grain size number is 6.5 or more in view of the productivity, pickling capability and surface quality.

Other conditions in the manufacture process may be determined as desired. For instance, slab thickness, hot-rolling sheet thickness and the like may be determined as desired. The roll roughness, roll diameter, rolling oil, rolling pass number, rolling speed, rolling temperature and the like in the cold rolling may be determined as desired within a range compatible with an object of the invention. When the intermediate annealing is performed during the cold rolling, any one of batch annealing and continuous annealing may be employed. The annealing may be performed in a low-oxygen atmosphere (e.g. hydrogen gas or nitrogen gas) (bright annealing) or may be performed in the atmospheric air as needed. Further, lubrication painting may be applied to the product sheet to further enhance pressing formability. In such an arrangement, the type of the lubrication film may be determined as desired.

The stainless steel sheet according to the above exemplary embodiment exhibits a high r-value and low ridging height and is excellent in pressing formability. Accordingly, the ferritic stainless steel pipe made of the stainless steel sheet of the exemplary embodiment is excellent in pipe expansivity and formability. The method for manufacturing the steel pipe may be determined as desired, where any welding process may be used (e.g. ERW, laser welding, TIG).

A ferritic stainless steel sheet for an automobile exhaust component can be provided using the stainless steel sheet of the exemplary embodiment. Especially, with the use of the stainless steel sheet for exhaust components of automobiles or motorcycles, degree of freedom for molding is enhanced and integral molding and the like without requiring welding between components becomes possible, thereby enabling efficient manufacture of components.

A second exemplary embodiment adapted to achieve the above-described second object will be described below.

Examples of indexes for formability include the r-value indicating deep drawability. The r-value is influenced by the crystal orientation of the steel and increases as more {111}-crystal orientations (so-called Y-fiber, i.e. crystal grains having {111} crystal face parallel to a sheet face of the steel sheet in a body-centered cubic crystal structure) are present.

In the invention, it is found that the {111}-orientation intensity of a product sheet increases and generation of the {311}<136> texture that reduces formability can be restrained by applying the intermediate annealing between the intermediate cold rolling and the finish cold rolling in the steel sheet manufacturing process.

Figure 3:
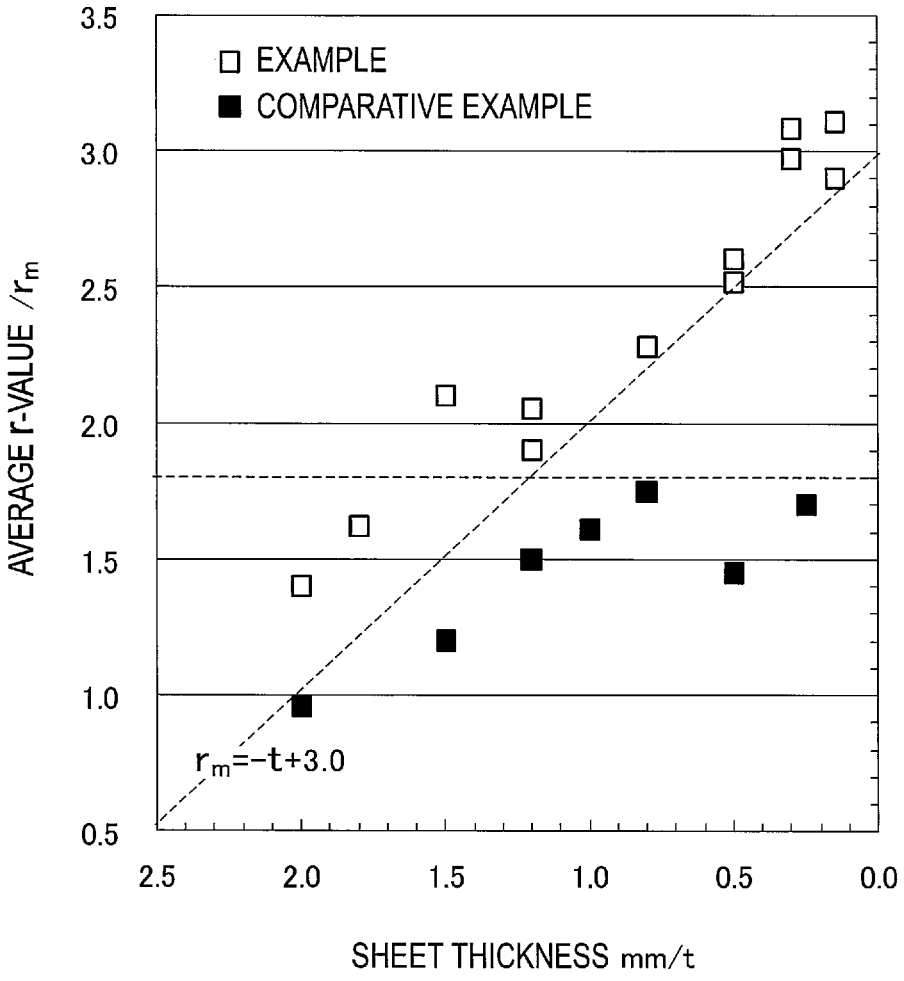
FIG. 3 illustrates a relationship between a sheet thickness and an average r-value ($r_m$) of the product sheet.

The average r-value ($r_m$) of the steel sheet of the exemplary embodiment is $r_m \geq -1.0t+3.0$, which shows excellent formability. FIG. 3 shows average r-values of Examples manufactured in accordance with the present exemplary embodiment (white squares in FIG. 3) and average r-values of steel sheets (Comparative Example: black squares in FIG. 3) manufactured in accordance with processes not satisfying the conditions of the exemplary embodiment, with reference to the sheet thickness. When the sheet thickness is t (mm) and the average r-value is $r_m$, since the average r-value of the ferritic stainless steel sheet manufactured according to the exemplary embodiment satisfies $-r_m \geq -1.0t+3.0$, the relationship between the average r-value and the sheet thickness is represented by $r_m \geq -1.0t+3.0$. Further, considering that 1.8 or more of average r-value is necessary in order to perform a 2D pipe expansion of a steel pipe when the sheet thickness t is 1.2 mm or more, it is desirable that, when $t \geq 1.2$ mm, $r_m \geq -1.0t+3.0$.

Figure 4:
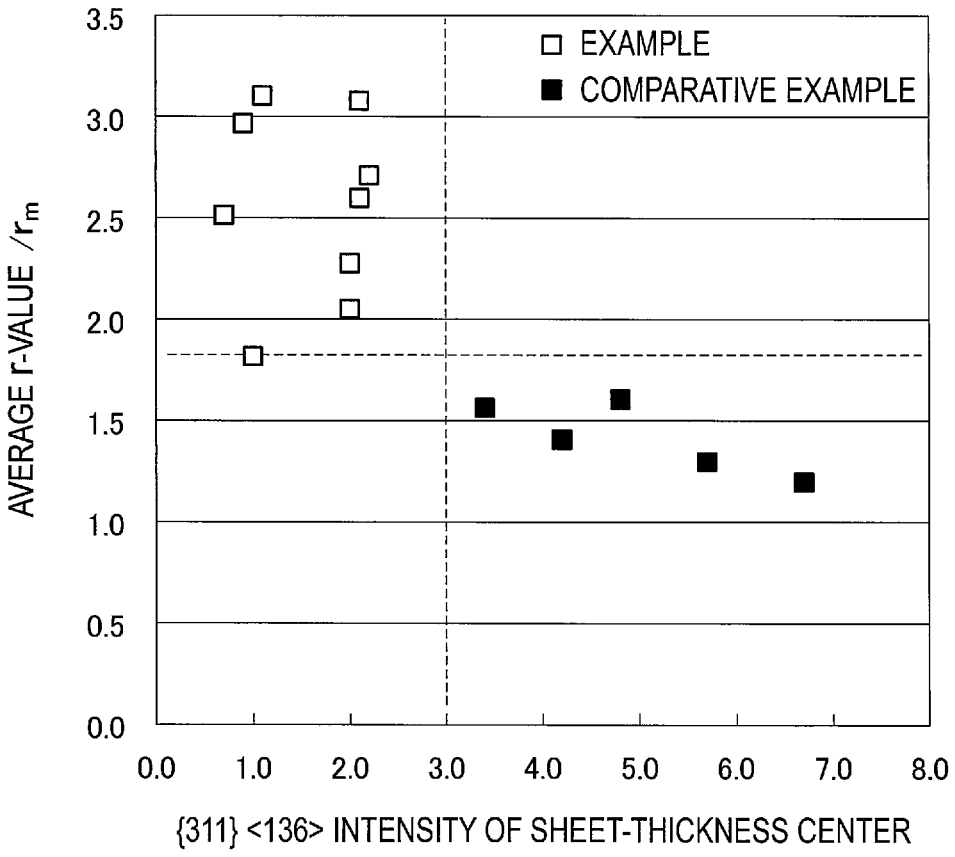
FIG. 4 illustrates a relationship between the average r-value {$r_m$}, and {311}<136>-orientation intensity of a product sheet.

FIG. 4 illustrates a relationship between the average r-value and {311}<136>-orientation intensity. In order for the average r-value to be 1.8 or more (i.e. a value capable of enduring 2D pipe expansion), it is necessary for the {111}<110>-orientation intensity to be 4.0 or more. The data plotted in FIG. 4 all show {111}<110>-orientation intensity of 4.0 or more. Further, as is clear from FIG. 4, when the {311}<136>-orientation intensity is 3.0 or more, the average r-value becomes extremely small. Based on the above, {111}<110>-orientation intensity is defined at 4.0 or more and {311}<136>-orientation intensity is defined at less than 3.0 in the invention. More preferably, {111}<110>-orientation intensity is defined at 7 or more and {311}<136>-orientation intensity is defined at less than 2.

In the invention, without relying on the conventionally known increase in the r-value by increasing the {111}<110>-orientation intensity, a high r-value is achieved by reducing the {311}<136>-orientation intensity.

Further, the grain size number of the steel sheet of the invention is preferably adjusted to be 6 or more. When the grain size number is less than 6, ridging or surface roughness (so-called orange peel) becomes prominent. Accordingly, the lower limit of the grain size number is defined at 6. Further preferably, the grain size number is 6.5 or more.

Next, a composition of the steel will be described below. It should be noted that the percentages used in indicating the composition all represent mass %.

C deteriorates formability and corrosion resistance. Especially, the development in the {311}-crystal orientation is greatly affected by solid solution C. Accordingly, the C content is preferably as small as possible and the upper limit of the C content is defined at 0.03%. However, excessive reduction of the C content results in increase in refining cost. Accordingly, the lower limit of the C content is defined at 0.001%. In addition, the C content is preferably 0.002% or more in view of the production cost. The C content is preferably 0.01% or less in view of boundary corrosivity at a welded part.

Similarly to C, N deteriorates formability and corrosion resistance. In addition, the growth of the {311}-orientated grains is greatly affected by solid solution N. Accordingly, the N content is preferably as small as possible and the upper limit of the N content is defined at 0.03%. However, excessive reduction in the N content results in increase in refining cost. Accordingly, the lower limit of the N content is defined at 0.001%. In addition, the N content is preferably 0.005% or more in view of the production cost. The N content is preferably 0.015% or less in view of formability and corrosion resistance.

Si is sometimes added as a deoxidizing element. In addition, Si improves the oxidation resistance. On the other hand, since Si is a solid solution strengthening element, the Si content is preferably 1.0% or less in order to ensure total elongation. Further, much amount of added Si causes change in a slip system to promote the growth in the {311}-crystal orientation. Accordingly, the upper limit of the Si content is defined at 1.0%. In addition, the Si content is preferably 0.2% or more in view of the corrosion resistance. The Si content is more preferably 0.3% or more. The Si content is further preferably 0.32% or more. The Si content is still further preferably 0.4% or more. The Si content is preferably 0.5% or less in view of the production cost.

Similarly to Si, Mn is a solid solution strengthening element. Accordingly, the upper limit of the Mn content is defined at 3.0% in view of the material. In addition, the Mn content is preferably 0.1% or more in view of the corrosion resistance. The Mn content is more preferably 0.3% or more. The Mn content is further preferably 0.32% or more. The Mn content is still further preferably 0.4% or more. The Mn content is preferably 0.5% or less in view of the production cost.

Since P is a solid solution strengthening element similarly to Mn and Si, the P content in the material is preferably as small as possible. Further, much amount of added P causes change in the slip system to promote the growth in the {311}-crystal orientation. Accordingly, the upper limit of the P content is defined at 0.04%. In addition, the P content is preferably 0.01% or more in view of the production cost. The P content is preferably 0.02% or less in view of the corrosion resistance.

S is an element that deteriorates corrosion resistance. Accordingly, the upper limit of the S content is defined at 0.01%. On the other hand, S forms $Ti_4C_2S_2$ in Ti-containing steel at a high temperature to contribute to the growth in the texture effective for improving the r-value. The formation of $Ti_4C_2S_2$ is exhibited when S is contained at an amount of 0.0003% or more. Accordingly, the lower limit of the S content is defined at 0.0003%. In addition, the S content is preferably 0.0005% or more in view of the production cost. The S content is preferably 0.0050% or less in view of boundary corrosivity in produced components.

Cr is an element that improves corrosion resistance and oxidation resistance. In view of environment in which exhaust components are provided, 10% or more of Cr is necessary in order to restrain abnormal oxidation. The Cr content is still further preferably 10.5% or more. On the other hand, excessive addition of Cr hardens the steel to deteriorate the formability, restrains the growth of the {111}-oriented grains and promotes the growth of the {311}-oriented grains. Further, in fear of increase in the production cost, the upper limit of the Cr content is defined at 30%. It should be noted that, in view of the production cost, sheet breakage due to deterioration in toughness and formability during the production of steel sheet, the upper limit of the Cr content is preferably less than 15%. When the Cr content is 15% or more, the steel hardens to promote the growth of the {311}-oriented grains. The upper limit of the Cr content is preferably 13% or less.

Al is sometimes added as a deoxidizing element. In addition, Al restrains the oxide scales from peeling. The Al content is preferably 0.01% or more. On the other hand, the added Al content exceeding 0.300% causes reduction in elongation, and deterioration in weld compatibility and surface quality. Accordingly, the upper limit of the Al content is defined at 0.300%. Further, the Al content is preferably 0.15% or less in view of the refining cost and pickling capability during steel sheet production.

The stainless steel sheet of the exemplary embodiment contains one or more of Ti and Nb.

Ti is an element added to be bonded to C, N and S to improve the corrosion resistance, intercrystalline corrosion resistance and deep drawability. The fixing function for C and/or N appears at a Ti concentration of 0.05% or more. When the Ti concentration is less than 0.05%, solid solution C and solid solution N that greatly contributes to the growth of the {311}-crystal orientation cannot be sufficiently fixed. Accordingly, the lower limit of the Ti content is defined at 0.05%. The Ti content is preferably 0.06% or more. Further, when more than 0.30% of Ti is added, the product is hardened due to solid solution Ti to cause the growth of the {311}-orientated grains and deterioration of toughness. Accordingly, the upper limit of the Ti content is defined at 0.30%. Further, the Ti content is preferably 0.25% or less in view of the production cost and the like.

Similarly to Ti, Nb is an element added to be bonded to C, N and S to improve the corrosion resistance, intercrystalline corrosion resistance and deep drawability. Nb is added as necessary because Nb is effective for improvement in formability and high-temperature strength due to the growth in the {111}-oriented grains and for inhibition of crevice corrosion and promotion of repassivation. The function due to the addition of Nb is exhibited at a Nb concentration of 0.01% or more. Accordingly, the lower limit of the Nb content is defined at 0.01%. The Nb content is preferably 0.05% or more. However, excessive addition of Nb hardens the steel to deteriorate the formability, restrains the growth of the {111}-oriented grains and promotes the growth of the {311}-oriented grains. Accordingly, the upper limit of the Nb content is defined at 0.50%. Further, the Nb content is preferably 0.3% or less in view of the production cost.

Further, the addition of Ti and Nb is scarcely effective when the sum of the contents of Ti and Nb is less than 8(C+N) (i.e. Theight times as much as the sum of C and N contents: when much amounts of C and N are present) or less than 0.05% (when the amounts of C and N are small). When the sum of the contents of Ti and Nb exceeds 0.75%, the solid solution Ti and solid solution Nb unfavorably increase to raise the recrystallization temperature. The sum of the contents of Ti and Nb are defined to be smaller one of 8(C+N) and 0.05% or more, and 0.75% or less.

The stainless steel sheet according to the exemplary embodiment may further optionally contain the following elements.

B is an element that enhances secondary formability by segregation at grain boundaries. In order to restrain vertical crack of an exhaust component when the exhaust component is subjected to a secondary processing, especially in winter, 0.0002% or more of B has to be added. The B content is preferably 0.0003% or more. However, addition of excessive amount of B restrains the growth of the {111}-oriented grains and reduces formability and corrosion resistance. Accordingly, the upper limit of the B content is defined at 0.0030%. In addition, the B content is preferably 0.0015% or less in view of the refining cost and decrease in ductility.

Ni is added as necessary in order to restrain crevice corrosion and promote repassivation. The function due to the addition of Ni is exhibited at Ni content of 0.1% or more. Accordingly, the lower limit of the Ni content is defined at 0.1%. The Ni content is more preferably 0.2% or more. However, since the excessive addition of Ni causes hardening of the steel to deteriorate the formability and is likely to cause stress corrosion crack, the upper limit of the Ni content is defined at 1.0%. It should be noted that the Ni content is preferably 0.8% or less in view of the material cost. The Ni content is more preferably 0.5% or less.

Mo is an element that improves corrosion resistance, which, especially when there is a crevice structure, restrains crevice corrosion. The function due to the addition of Mo is exhibited at Mo content of 0.1% or more. Accordingly, the lower limit of the Mo content is defined at 0.1%. When the Mo content exceeds 2.0%, significant deterioration in formability and productivity occurs. Further, though an appropriate amount of Mo restrains the growth of the {311}-oriented grains and promotes sharp growth of the {111}-crystal orientation, excessive addition of Mo causes hardening due to solid solution Mo and growth in the {311}-oriented grains. Accordingly, the upper limit of the Mo content is defined at 2.0%. It should be noted that the Mo content is preferably 0.5% or less in view of the alloy cost and productivity.

Cu is added as necessary in order to restrain crevice corrosion and promote repassivation. The function due to the addition of Cu is exhibited at Cu content of 0.1% or more. Accordingly, the lower limit of the Cu content is defined at 0.1%. The Cu content is preferably 0.15% or more. However, addition of excessive amount of Cu causes hardening of the steel and deteriorates formability. Accordingly, the upper limit of the Cu content is defined at 3.0%. The Cu content is preferably 1.0% or less.

V is added as necessary in order to restrain crevice corrosion. The function due to the addition of V is exhibited at V content of 0.05% or more. Accordingly, the lower limit of the V content is defined at 0.05%. The V content is preferably 0.1% or more. However, addition of excessive amount of V causes hardening of the steel and deteriorates formability. Accordingly, the upper limit of the V content is defined at 1.0%. It should be noted that the V content is preferably 0.5% or less in view of the material cost.

Ca is added as necessary for desulfurization. The function due to the addition of Ca is not exhibited at Ca content of less than 0.0002%. Accordingly, the lower limit of the Ca content is defined at 0.0002%. On the other hand, water-soluble inclusion in a form of CaS is generated when more than 0.0030% of Ca is added to reduce the r-value. Further, the corrosion resistance is considerably reduced. Accordingly, the upper limit of the Ca content is defined at 0.0030%. In addition, the Ca content is preferably 0.0015% or less in view of surface quality.

Mg is sometimes added as deoxidizing element. Further, Mg is an element that miniaturizes slab structure to contribute to growth of texture that enhances formability. The function due to the addition of Mg is exhibited at Mg content of 0.0002% or more. Accordingly, the lower limit of the Mg content is defined at 0.0002%. The Mg content is preferably 0.0003% or more. However, addition of excessive amount of Mg deteriorates weldability and corrosion resistance. Accordingly, the upper limit of the Mg content is defined at 0.0030%. The Mg content is preferably 0.0010% or more in view of the refining cost.

Sn is an element that contributes to improvement in corrosion resistance and high-temperature strength. Accordingly, 0.005% or more of Sn is added as necessary. The Sn content is preferably 0.003% or more. However, addition of more than 0.50% of Sn may cause slab cracking during the production of steel sheets. Accordingly, the upper limit of the Sn content is defined at 0.50%. The Sn content is preferably 0.30% or less in view of the refining cost and productivity.

Zr is an element that is bonded with C and/or N to promote growth in texture. Accordingly, 0.01% or more of Zn is added as necessary. The Zr content is preferably 0.03% or more. However, the addition of more than 0.30% of Zr results in increase in the production cost and considerable deterioration in productivity. Accordingly, the upper limit of the Zr content is defined at 0.30%. The Zr content is preferably 0.20% or less in view of the refining cost and productivity.

W is an element that contributes to improvement in corrosion resistance and high-temperature strength. Accordingly, 0.01% or more of W is added as necessary. However, addition of more than 3.0% of W results in deterioration in toughness during the production of steel sheets and increase in the production cost. Accordingly, the upper limit of the W content is defined at 3.0%. The W content is preferably 0.10% or less in view of the refining cost and productivity.

Co is an element that contributes to improvement in high-temperature strength. Accordingly, 0.01% or more of Co is added as necessary. However, addition of more than 0.30% of Co results in deterioration in toughness during the production of steel sheets and increase in the production cost. Accordingly, the upper limit of the Co content is defined at 0.30%. The Co content is preferably 0.10% or less in view of the refining cost and productivity.

Sb is an element that enhances high-temperature strength by segregation at grain boundaries. The function due to the addition of Sb is exhibited at Sb content of 0.005% or more. Accordingly, the lower limit of the Sb content is defined at 0.005%. The Sb content is preferably 0.03% or more. The Sb content is more preferably 0.05% or more. However, when more than 0.50% of Sb is added, cracks may be caused during welding process due to segregation of Sb. Accordingly, the upper limit of the Sb content is defined at 0.50%. The Sb content is preferably 0.30% or less in view of high-temperature characteristics, production cost and toughness. The Sb content is more preferably 0.20% or less.

REM (Rare Earth Metal) is a group of elements that contributes to improvement in oxidation resistance. Accordingly, 0.001% or more of REM is added as necessary. Even when more than 0.20% of REM is added, the effect of the addition of REM is saturated and the corrosion resistance is reduced due to sulfide of REM. Accordingly, REM is added in an amount ranging from 0.001 to 0.20%. The lower limit of the REM content is preferably defined at 0.002%. The upper limit of the content of REM is preferably 0.10% in view of formability of the product and production cost. The REM refers to those elements according to general definition. Specifically, REM refers to a group of elements consisting of: two elements of scandium (Sc) and yttrium (Y); and fifteen elements (lanthanoid) from lanthanum (La) to lutetium (Lu). REM may be singly added or may be added in a form of a mixture.

0.3% or less of Ga may be added in order to improve corrosion resistance and restrain hydrogen embrittlement. When more than 0.3% of Ga is added, coarse sulfide is generated to restrain the increase in the {111}<110>-orientation intensity. The lower limit of the Ga content is defined at 0.0002% in view of formation of sulfides and hydrides. In addition, the Ga content is preferably 0.0020% or more in view of the productivity and production cost.

0.001% to 1.0% of Ta and/or Hf may be added in order to improve the high-temperature strength. 0.01% or more of Ta and/or Hf is effective and 0.1% or more of Ta and/or Hf further enhances the strength. In addition, 0.001 to 0.02% of Bi may be added as necessary. It should be noted that the content of common detrimental impurity element (e.g. As and Pb) should be as small as possible.

The stainless steel sheet of the above exemplary embodiment may be preferably used as a ferritic stainless steel sheet with excellent formability suitable for automobile or motorcycle components. More specifically, the stainless steel sheet of the above exemplary embodiment may be preferably used as a ferritic stainless steel sheet with excellent formability suitable for exhaust pipe, fuel tank or fuel pipe for automobiles. With the use of the stainless steel sheet for producing automobile or motorcycle components (specifically, exhaust pipes, fuel tank or fuel pipe of automobiles), degree of freedom for molding is enhanced and integral molding and the like without requiring welding between components becomes possible, thereby enabling efficient manufacture of components.

The ferritic stainless steel pipe with excellent formability made of the stainless steel sheet of the above exemplary embodiment has formability sufficient to provide a steel pipe made of a relatively thick steel sheet having more than 1 mm thickness and capable of enduring 2D pipe expansion processing (a processing expanding an end diameter D of the pipe to 2D (i.e. double the diameter).

Next, a manufacturing method will be described below. A manufacturing method of steel sheet of the exemplary embodiment includes steps of steelmaking, hot rolling, pickling, and subsequent repetitions of cold rolling and annealing. In the steelmaking, steel containing the above-described essential components and component(s) added as necessary are suitably melted in a converter furnace and subsequently subjected to a secondary smelting. The melted steel is formed into a slab according to known casting process (continuous casting). The slab is heated to a predetermined temperature and is hot-rolled to have a predetermined thickness through a continuous rolling procedure.

In the exemplary embodiment, the slab is subjected to pickling without applying annealing of hot-rolled sheet and is subjected to the cold rolling process as a cold rolling material. The above process is different from a typical procedure (typically, the annealing of hot-rolled sheet is applied). Though the annealing of hot-rolled sheet is applied to obtain a granulated recrystallization texture in the typical procedure, it is difficult in the typical procedure to significantly reduce the size of the crystal grains before the cold rolling. When the size of the crystal grain before the cold rolling is large, a grain boundary area reduces so that the {111}-crystal orientation improving the r-value does not grow in a product sheet but the {311}-crystal orientation grows. Accordingly, it is found in the exemplary embodiment that texture should be miniaturized by promoting the recrystallization during the hot rolling process without applying the hot-rolling sheet annealing.

The cast slab is heated at 1100 to 1200 degrees C. When the slab is heated at a temperature more than 1200 degrees C., the crystal grains are coarsened so that the texture is not miniaturized during the hot rolling process. Thus, the {111}-crystal orientation does not grow but the {311}-crystal orientation unfavorably grows to reduce the r-value. When the slab is heated at a temperature less than 1100 degrees C., only the deformation texture is grown without causing the recrystallization. Thus, the {111}-crystal orientation does not grow but the {311}-crystal orientation grows to reduce the r-value. In addition, ridging characteristics of the product sheet becomes unfavorable. Thus, the favorable slab heating temperature is defined in a range from 1100 to 1200 degrees C. In addition, the heating temperature is preferably 1160 degrees C. or less in view of the productivity. The heating temperature is preferably 1120 degrees C. or more in view of surface scar.

In the hot rolling process after heating the slab, a plurality of passes of rough rolling and unidirectional finish rolling using a plurality of stands are applied. After the rough rolling, finish rolling is applied at a high speed and the product is wound in a coil. In the exemplary embodiment, in order to obtain minute recrystallized texture during the winding step, rough rolling temperature and coiling temperature are defined. In order to improve formability, it is important to recrystallize the product to form minute textures after the product is wound. Formation of the minute textures after the product is wound can restrain shear deformation during the subsequent cold rolling process, can reduce the formation of the {311}-texture and further can grow the {111}-texture. When the coiling temperature is excessively low, since the recrystallization does not occur during the winding process, it is necessary to perform the finish rolling at a high temperature and a high speed. Accordingly, the finish rolling process is defined so that a start temperature is 900 degrees C. or more and end temperature is 800 degrees C. or more, a difference between the start and end temperatures is 200 degrees C. or less and the coiling temperature is also defined to be 600 degrees C. or more. It is preferable that the start temperature is 950 degrees C. or more, the end temperature is 820 degrees C. or more and the difference between the start and end temperatures is 150 degrees C. or less.

In the exemplary embodiment, the product is subjected to pickling without applying the annealing of hot-rolled sheet and is subjected to the cold rolling process. The above process is different from a typical procedure (typically, the annealing of hot-rolled sheet is applied), which, in combination with the above-described conditions for hot rolling, provides minute recrystallized grains during the cold rolling to achieve the improvement in the r-value, In the cold rolling process, intermediate cold rolling, intermediate annealing, finish cold rolling, and finish annealing are performed in this order.

The cold rolling may be performed using a reversible 20-stage Sendzimir rolling mill or a 6 or 12-stage tandem rolling mill configured to continuously roll a plurality of passes. It should be noted, however, the cold rolling is at least once performed at 40% or more of rolling reduction using a roller having a diameter of 400 mm or more. The roll diameter of 400 mm or more restrains shear strains during the cold rolling and also restrains the generation of crystal orientation (e.g. {311}<136>) that reduces the r-value during the subsequent annealing process. The above large-roller rolling is preferably performed during the intermediate cold rolling.

In the intermediate annealing performed in the middle stage of the cold rolling, a recrystallization texture or a texture immediately before completion of recrystallization is obtained. The grain size number of the texture immediately before completion of recrystallization is preferably 6 or more. When the grain size number is less than 6, since the grain size is large, {111}-oriented grains are unlikely to be generated from the grain boundary, which hinders improvement in the r-value especially in a thick material. The grain size number is further preferably 6.5 or more. In order to satisfy the above conditions, the intermediate annealing temperature is set in a range from 800 to 880 degrees C. Though the annealing is applied at a temperature of more than 880 degrees C. in order to grow the size of the recrystallized grains in a typical intermediate annealing, the annealing is applied at a temperature lower than that in the typical intermediate annealing in order to obtain minute textures immediately before the recrystallization or immediately after the recrystallization in the exemplary embodiment. The intermediate annealing temperature of less than 800 degrees C. causes non-recrystallized textures. Accordingly, the lower limit of the intermediate annealing temperature is defined at 800 degrees C. In addition, the intermediate annealing temperature is preferably 825 degrees C. or more in view of the productivity and pickling capability. Further, the intermediate annealing temperature is preferably less than 870 degrees C. in view of the productivity and pickling capability. Herein, the recrystallization completion texture refers to a texture in which all of the grains are equiaxially recrystallized and the texture immediately before the completion of recrystallization refers to a texture in which slightly stretched non-recrystallized texture remains in addition to the equiaxial crystal grains.

In the finish cold rolling, since high rolling reduction results in increase in accumulated energy as a driving force of recrystallization so that it is likely that nucleus of the {111}-crystal orientation is preferentially generated and the {111}-crystal orientation is selectively grown. Accordingly, at least 60% rolling reduction is applied during the cold rolling.

The annealing temperature in the finish annealing after the finish cold rolling is set in a range from 850 to 950 degrees C. to adjust the grain size number at 6 or more. When the grain size number is less than 6, ridging or surface roughness (so-called orange peel) becomes prominent. Accordingly, the lower limit of the grain size number is preferably defined at 6. The grain size number is preferably 6.5 or more. In addition, the annealing temperature is preferably 880 degrees C. or more in view of the productivity, pickling capability and surface quality. Furthermore, the annealing temperature is preferably 910 degrees C. or less in view of the productivity, pickling capability and surface quality.

EXAMPLES

Examples for the above-described first exemplary embodiment will be described below.

Steels of compositions shown in Tables 1-1 and 1-2 were melted and cast into a slab. Ten, the steels were subjected to hot rolling, (without applying the annealing of hot-rolled sheet), cold rolling, intermediate annealing, finish cold rolling and finish annealing to obtain a product sheet having 1.2 mm thickness. It should be noted that, regarding the conditions for the hot rolling, rough rolling reduction and finish rolling reduction were also studied, where the characteristics of each of the steels were examined. The steels were manufactured under the conditions shown in Tables 2-1, 2-2 and 2-3. Evaluation methods for the {111}-orientation intensity, {411}-orientation intensity, average r-value and ridging in the vicinity of the sheet-thickness central portion are as described above.

TABLE 1-1

| | Steel No. | Content (mass %) C | Si | Mn | P | S | Cr | N | Ti | Nb | B | Al |
|---|---|---|---|---|---|---|---|---|---|---|---|---|
| Exemplary Embodiment | A1 | 0.005 | 0.45 | 0.12 | 0.02 | 0.0007 | 11.1 | 0.009 | 0.17 | — | — | — |
| | A2 | 0.008 | 0.25 | 0.18 | 0.02 | 0.0008 | 17.3 | 0.013 | — | 0.28 | — | — |
| | A3 | 0.003 | 0.43 | 0.42 | 0.03 | 0.0012 | 13.9 | 0.010 | 0.19 | — | 0.0010 | 0.05 |
| | A4 | 0.009 | 0.22 | 0.12 | 0.03 | 0.0023 | 11.1 | 0.014 | 0.22 | — | 0.0005 | 0.07 |
| | A5 | 0.002 | 0.44 | 0.35 | 0.03 | 0.0043 | 17.9 | 0.006 | 0.22 | — | 0.0011 | 0.04 |
| | A6 | 0.006 | 0.43 | 0.12 | 0.02 | 0.0018 | 17.5 | 0.006 | 0.08 | — | 0.0005 | — |
| | A7 | 0.004 | 0.21 | 0.15 | 0.03 | 0.0005 | 11.7 | 0.011 | 0.19 | 0.12 | 0.0004 | 0.03 |
| | A8 | 0.003 | 0.33 | 0.23 | 0.03 | 0.0032 | 14.2 | 0.010 | 0.09 | — | 0.0010 | 0.05 |
| | A9 | 0.008 | 0.11 | 0.12 | 0.03 | 0.0007 | 17.5 | 0.009 | 0.14 | — | 0.0004 | 0.08 |
| | A10 | 0.005 | 0.32 | 0.27 | 0.02 | 0.0007 | 11.8 | 0.016 | 0.25 | — | 0.0006 | 0.12 |
| | A11 | 0.009 | 0.34 | 0.10 | 0.03 | 0.0008 | 14.4 | 0.014 | 0.07 | — | 0.0006 | 0.09 |
| | A12 | 0.005 | 0.28 | 0.18 | 0.01 | 0.0031 | 17.3 | 0.006 | 0.18 | 0.25 | 0.0004 | 0.02 |
| | A13 | 0.006 | 0.44 | 0.15 | 0.03 | 0.0009 | 12.3 | 0.006 | 0.17 | — | 0.0004 | 0.07 |
| | A14 | 0.005 | 0.35 | 0.12 | 0.02 | 0.0005 | 11.5 | 0.009 | 0.17 | — | — | — |
| | A15 | 0.007 | 0.24 | 0.28 | 0.02 | 0.0008 | 17.3 | 0.013 | 0.24 | — | — | — |
| | A16 | 0.003 | 0.43 | 0.33 | 0.03 | 0.0012 | 13.9 | 0.010 | 0.19 | — | — | — |
| | A17 | 0.007 | 0.43 | 0.15 | 0.03 | 0.0008 | 13.5 | 0.015 | 0.16 | — | — | — |
| | A18 | 0.009 | 0.47 | 0.23 | 0.02 | 0.0006 | 13.4 | 0.013 | 0.23 | — | — | — |
| | A19 | 0.008 | 0.24 | 0.32 | 0.03 | 0.0006 | 12.5 | 0.008 | 0.25 | — | — | — |
| | A20 | 0.005 | 0.46 | 0.22 | 0.02 | 0.0006 | 11.5 | 0.013 | 0.19 | — | — | — |
| | A21 | 0.025 | 0.54 | 0.33 | 0.04 | 0.0013 | 19.7 | 0.027 | 0.28 | 0.45 | — | — |
| | A22 | 0.011 | 0.88 | 0.93 | 0.04 | 0.0006 | 13.9 | 0.013 | — | 0.85 | — | 0.18 |
| | A23 | 0.016 | 0.56 | 0.25 | 0.03 | 0.0025 | 17.1 | 0.013 | 0.19 | 0.39 | 0.0009 | 0.11 |
| | A24 | 0.007 | 0.16 | 0.15 | 0.03 | 0.0019 | 13.5 | 0.015 | — | 0.16 | 0.0025 | 0.25 |
| | A25 | 0.019 | 0.75 | 0.12 | 0.01 | 0.0088 | 11.5 | 0.013 | 0.23 | — | — | — |
| | A26 | 0.009 | 0.28 | 0.32 | 0.03 | 0.0006 | 17.3 | 0.019 | 0.12 | 0.53 | 0.0005 | 0.10 |
| | A27 | 0.013 | 0.22 | 0.35 | 0.05 | 0.0035 | 17.1 | 0.013 | — | 0.51 | 0.0009 | 0.09 |

| | Steel No. | Content (mass %) Ni | Mo | Cu | V | Mg | Sn | Others |
|---|---|---|---|---|---|---|---|---|
| Exemplary Embodiment | A1 | — | — | — | — | — | — | — |
| | A2 | — | — | — | — | — | — | — |
| | A3 | — | — | — | — | — | — | — |
| | A4 | — | — | 1.2 | 0.12 | — | — | — |
| | A5 | 0.2 | — | — | — | — | — | — |
| | A6 | — | 0.8 | — | — | — | — | — |
| | A7 | — | — | 0.3 | — | — | — | — |
| | A8 | — | — | — | 0.19 | 0.0005 | — | — |
| | A9 | — | — | — | — | — | 0.11 | — |
| | A10 | — | — | — | — | — | — | Zr: 0.03 |
| | A11 | — | — | — | — | — | — | W: 1.5 |
| | A12 | — | — | 1.30 | — | — | — | Co: 0.05 |
| | A13 | 0.13 | 0.12 | 0.11 | 0.13 | 0.0003 | — | — |
| | A14 | — | — | — | — | — | 0.01 | — |
| | A15 | — | — | — | — | — | — | Sb: 0.01 |
| | A16 | — | — | — | — | — | — | REM: 0.005 |
| | A17 | — | — | — | — | — | — | Ca: 0.0010 |
| | A18 | — | — | — | — | — | — | Ga: 0.0020 |
| | A19 | — | — | — | — | — | — | Hf: 0.006 |
| | A20 | — | — | — | — | — | — | Ta: 0.005 |
| | A21 | — | — | — | — | — | — | — |
| | A22 | — | — | — | — | — | — | — |
| | A23 | — | — | — | 0.81 | — | — | — |
| | A24 | — | — | — | — | 0.0022 | — | — |
| | A25 | 0.80 | 1.8 | — | — | — | — | — |
| | A26 | 0.10 | 0.3 | 1.2 | 0.10 | — | — | — |
| | A27 | — | 1.8 | 1.5 | — | — | — | W: 2.8 |

TABLE 1-2

| | Steel No. | Content (mass %) C | Si | Mn | P | S | Cr | N | Ti | Nb | B | Al |
|---|---|---|---|---|---|---|---|---|---|---|---|---|
| Comparative Example | B1 | 0.035* | 0.24 | 0.37 | 0.02 | 0.0009 | 10.7 | 0.011 | — | 0.22 | — | — |
| | B2 | 0.005 | 0.95* | 0.25 | 0.02 | 0.0009 | 17.3 | 0.006 | 0.18 | — | 0.0009 | 0.09 |
| | B3 | 0.013 | 0.32 | 1.53* | 0.02 | 0.0012 | 14.5 | 0.010 | 0.22 | — | — | — |
| | B4 | 0.003 | 0.42 | 0.43 | 0.06* | 0.0003 | 16.3 | 0.010 | 0.12 | — | 0.0007 | 0.05 |
| | B5 | 0.007 | 0.26 | 0.32 | 0.02 | 0.0192* | 18.8 | 0.013 | 0.16 | — | — | — |
| | B6 | 0.012 | 0.31 | 0.34 | 0.04 | 0.0026 | 22.3* | 0.005 | 0.08 | — | 0.0005 | — |
| | B7 | 0.004 | 0.25 | 0.36 | 0.02 | 0.0015 | 17.5 | 0.04* | 0.22 | — | — | — |

TABLE 1-2-continued

| | | | | | | | | | | | |
|---|---|---|---|---|---|---|---|---|---|---|---|
| B8 | 0.003 | 0.26 | 0.12 | 0.03 | 0.0053 | 14.1 | 0.015 | 1.55* | — | — | — |
| B9 | 0.008 | 0.39 | 0.12 | 0.03 | 0.0035 | 16.2 | 0.005 | 0.23 | — | 0.0100* | — |
| B10 | 0.009 | 0.29 | 0.26 | 0.01 | 0.0015 | 19.5 | 0.005 | 0.17 | — | — | 0.44* |
| B11 | 0.006 | 0.36 | 0.33 | 0.04 | 0.0033 | 11.1 | 0.007 | 0.10 | — | — | — |
| B12 | 0.002 | 0.42 | 0.42 | 0.02 | 0.0032 | 13.8 | 0.006 | 0.10 | — | — | — |
| B13 | 0.003 | 0.17 | 0.26 | 0.03 | 0.0013 | 16.5 | 0.012 | 0.07 | 1.60* | — | 0.04 |
| B14 | 0.011 | 0.25 | 0.27 | 0.02 | 0.0023 | 11.9 | 0.006 | 0.11 | — | — | — |
| B15 | 0.005 | 0.31 | 0.21 | 0.01 | 0.0016 | 13.5 | 0.010 | 0.14 | — | — | 0.03 |
| B16 | 0.009 | 0.39 | 0.12 | 0.04 | 0.0022 | 14.5 | 0.013 | 0.22 | — | — | — |
| B17 | 0.006 | 0.21 | 0.33 | 0.03 | 0.0007 | 17.3 | 0.016 | 0.19 | — | — | — |
| B18 | 0.005 | 0.32 | 0.17 | 0.05 | 0.0011 | 13.6 | 0.013 | 0.09 | — | — | 0.06 |
| B19 | 0.005 | 0.21 | 0.25 | 0.01 | 0.0025 | 16.3 | 0.009 | 0.15 | — | — | 0.13 |
| B20 | 0.009 | 0.33 | 0.13 | 0.02 | 0.0016 | 10.8 | 0.015 | 0.12 | — | — | — |
| B21 | 0.005 | 0.32 | 0.17 | 0.05 | 0.0011 | 13.6 | 0.013 | 0.09 | — | — | — |
| B22 | 0.005 | 0.21 | 0.25 | 0.01 | 0.0025 | 16.3 | 0.009 | 0.15 | — | — | — |
| B23 | 0.009 | 0.33 | 0.13 | 0.02 | 0.0016 | 10.8 | 0.015 | 0.12 | — | — | — |
| B24 | 0.006 | 0.26 | 0.42 | 0.01 | 0.0026 | 14.2 | 0.009 | 0.33 | — | — | — |
| B25 | 0.011 | 0.23 | 0.31 | 0.02 | 0.0025 | 11.1 | 0.015 | 0.25 | — | — | — |

| | Steel | Content (mass %) | | | | | | |
|---|---|---|---|---|---|---|---|---|
| | No. | Ni | Mo | Cu | V | Mg | Sn | Others |
| Comparative Example | B1 | — | — | — | — | — | — | — |
| | B2 | — | — | — | — | — | — | — |
| | B3 | — | — | — | — | — | — | — |
| | B4 | — | — | — | — | — | — | — |
| | B5 | — | — | — | — | — | — | — |
| | B6 | — | — | — | — | — | — | — |
| | B7 | — | — | — | — | — | — | — |
| | B8 | — | — | — | — | — | — | — |
| | B9 | — | — | — | — | — | — | — |
| | B10 | — | — | — | — | — | — | — |
| | B11 | 1.3* | — | — | — | — | — | — |
| | B12 | — | 2.5* | — | — | — | — | — |
| | B13 | — | — | — | — | — | — | — |
| | B14 | — | — | 3.1* | — | — | — | — |
| | B15 | — | — | — | 1.12* | — | — | — |
| | B16 | — | — | — | — | 0.0045* | — | — |
| | B17 | — | — | — | — | — | 0.62* | — |
| | B18 | — | — | — | — | — | — | Zr: 0.53* |
| | B19 | — | — | — | — | — | — | W: 3.1* |
| | B20 | — | — | — | — | — | — | Co: 0.48* |
| | B21 | — | — | — | — | — | 0.7* | — |
| | B22 | — | — | — | — | — | — | Sb: 0.8* |
| | B23 | — | — | — | — | — | — | REM: 0.3* |
| | B24 | — | — | — | — | — | — | Ca: 0.004* |
| | B25 | — | — | — | — | — | — | Ga: 0.5* |

*Out of the scope of the invention

TABLE 2-1

| | | | Hot-Rolling Condition | | | | | | | | |
|---|---|---|---|---|---|---|---|---|---|---|---|
| | No. | Steel No. | heating temperature ° C. | total rolling reduction in Rough rolling % | rolling pass number in Rough rolling | rolling pass number with rolling reduction of 30% or more in Rough rolling | Rough Rolling End temperature ° C. | total rolling reduction in finish rolling % | Rough rolling reduction/finish rolling reduction | Finish Temperature ° C. | Coiling Temperature ° C. |
| Exemplary Embodiment | 1 | A1 | 1120 | 89 | 7 | 5 | 1020 | 82 | 1.1 | 830 | 640 |
| | 2 | A2 | 1120 | 87 | 7 | 5 | 1005 | 81 | 1.1 | 850 | 600 |
| | 3 | A3 | 1160 | 90 | 7 | 5 | 1020 | 78 | 1.2 | 820 | 580 |
| | 4 | A4 | 1160 | 89 | 7 | 6 | 1050 | 80 | 1.1 | 750 | 550 |
| | 5 | A5 | 1160 | 89 | 7 | 6 | 1010 | 75 | 1.2 | 800 | 630 |
| | 6 | A6 | 1120 | 89 | 7 | 5 | 1030 | 79 | 1.1 | 840 | 640 |
| | 7 | A7 | 1200 | 88 | 5 | 3 | 1060 | 82 | 1.1 | 830 | 600 |
| | 8 | A8 | 1120 | 89 | 7 | 5 | 1010 | 82 | 1.1 | 830 | 640 |
| | 9 | A9 | 1120 | 93 | 7 | 5 | 1010 | 80 | 1.2 | 850 | 600 |
| | 10 | A10 | 1160 | 88 | 7 | 5 | 1020 | 82 | 1.1 | 820 | 580 |
| | 11 | A11 | 1160 | 89 | 7 | 6 | 1030 | 78 | 1.1 | 750 | 550 |
| | 12 | A12 | 1160 | 92 | 7 | 5 | 1050 | 82 | 1.1 | 820 | 580 |
| | 13 | A13 | 1200 | 85 | 5 | 3 | 1050 | 80 | 1.1 | 850 | 610 |

TABLE 2-1-continued

| | | | | | | | | | | |
|---|---|---|---|---|---|---|---|---|---|---|
| 14 | A14 | 1120 | 89 | 7 | 5 | 1060 | 82 | 1.1 | 830 | 640 |
| 15 | A15 | 1120 | 89 | 7 | 5 | 1010 | 80 | 1.1 | 850 | 600 |
| 16 | A16 | 1160 | 90 | 7 | 5 | 1010 | 78 | 1.2 | 820 | 580 |
| 17 | A17 | 1120 | 89 | 7 | 5 | 1070 | 82 | 1.1 | 830 | 640 |
| 18 | A18 | 1120 | 91 | 7 | 5 | 1030 | 70 | 1.3 | 850 | 600 |
| 19 | A19 | 1160 | 89 | 5 | 5 | 1020 | 80 | 1.1 | 770 | 650 |
| 20 | A20 | 1150 | 88 | 5 | 4 | 1050 | 77 | 1.1 | 780 | 620 |
| 21 | A21 | 1200 | 88 | 7 | 5 | 1010 | 81 | 1.1 | 830 | 500 |
| 22 | A22 | 1160 | 87 | 7 | 5 | 1030 | 82 | 1.1 | 820 | 580 |
| 23 | A23 | 1200 | 89 | 5 | 3 | 1020 | 80 | 1.1 | 850 | 450 |
| 24 | A24 | 1160 | 90 | 7 | 5 | 1030 | 78 | 1.2 | 820 | 580 |
| 25 | A25 | 1160 | 90 | 7 | 5 | 1020 | 78 | 1.2 | 820 | 580 |
| 26 | A26 | 1200 | 91 | 7 | 5 | 1050 | 78 | 1.2 | 850 | 430 |
| 27 | A27 | 1200 | 88 | 7 | 5 | 1010 | 81 | 1.1 | 830 | 500 |

| | | Intermediate Rolling | | Intermediate Annealing | | | Final Annealing | |
|---|---|---|---|---|---|---|---|---|
| | | | | Annealing | | | Annealing | |
| | No. | Roll Diameter mm | Rolling Reduction % | Temperature ° C. | (111)Orientation Intensity | Grain size number | Temperature ° C. | Grain size number |
| Exemplary Embodiment | 1 | 500 | 44 | 850 | 3.1 | 7.2 | 900 | 7.2 |
| | 2 | 500 | 44 | 870 | 4.2 | 7.3 | 910 | 6.5 |
| | 3 | 500 | 55 | 870 | 3.3 | 7.5 | 900 | 5.9 |
| | 4 | 500 | 55 | 850 | 7.2 | 8.1 | 890 | 7.5 |
| | 5 | 450 | 46 | 830 | 5.4 | 7.5 | 900 | 7.9 |
| | 6 | 450 | 46 | 835 | 3.2 | 6.5 | 920 | 6.8 |
| | 7 | 400 | 44 | 850 | 6.1 | 6.8 | 925 | 6.3 |
| | 8 | 500 | 44 | 850 | 3.1 | 7.2 | 900 | 7.0 |
| | 9 | 500 | 44 | 870 | 4.3 | 7.5 | 910 | 6.5 |
| | 10 | 500 | 55 | 870 | 3.1 | 7.5 | 900 | 5.9 |
| | 11 | 500 | 55 | 850 | 7.2 | 8.1 | 890 | 7.5 |
| | 12 | 500 | 55 | 870 | 3.2 | 7.5 | 900 | 5.9 |
| | 13 | 400 | 44 | 850 | 8.1 | 7.2 | 940 | 7.0 |
| | 14 | 500 | 44 | 850 | 3.4 | 7.2 | 900 | 7.2 |
| | 15 | 500 | 44 | 870 | 4.4 | 7.3 | 910 | 6.5 |
| | 16 | 500 | 55 | 870 | 3.2 | 7.5 | 900 | 5.9 |
| | 17 | 500 | 44 | 850 | 3.3 | 7.2 | 900 | 7.2 |
| | 18 | 500 | 44 | 870 | 4.1 | 7.3 | 910 | 6.5 |
| | 19 | 500 | 45 | 840 | 5.2 | 7.7 | 900 | 6.8 |
| | 20 | 450 | 55 | 840 | 6.6 | 8.1 | 890 | 7.6 |
| | 21 | 500 | 44 | 870 | 4.1 | 7.5 | 950 | 6.3 |
| | 22 | 500 | 55 | 870 | 3.1 | 7.5 | 910 | 6.6 |
| | 23 | 500 | 44 | 880 | 3.8 | 7.6 | 950 | 7.1 |
| | 24 | 500 | 55 | 840 | 6.8 | 7.4 | 950 | 5.8 |
| | 25 | 500 | 55 | 880 | 3.2 | 7.4 | 900 | 6.2 |
| | 26 | 500 | 44 | 880 | 4.5 | 7.8 | 950 | 6.3 |
| | 27 | 500 | 44 | 870 | 4.1 | 7.5 | 950 | 6.3 |

| | | Characteristics of Product Sheet | | | | |
|---|---|---|---|---|---|---|
| | No. | (111)Orientation Intensity | (411)Orientation Intensity | Average r-value | Ridging Height μm | Result of Pipe Expansion Test |
| Exemplary Embodiment | 1 | 7.2 | 1.1 | 1.7 | 5 | A |
| | 2 | 8.1 | 1.1 | 1.8 | 7 | A |
| | 3 | 7.0 | 2.1 | 1.7 | 5 | A |
| | 4 | 9.2 | 1.2 | 1.8 | 6 | A |
| | 5 | 10.3 | 2.3 | 1.9 | 3 | A |
| | 6 | 6.0 | 2.1 | 1.7 | 2 | A |
| | 7 | 7.2 | 2.2 | 1.7 | 5 | A |
| | 8 | 10.1 | 1.1 | 1.9 | 5 | A |
| | 9 | 14.3 | 1.1 | 2.0 | 6 | A |
| | 10 | 8.0 | 2.1 | 1.8 | 8 | A |
| | 11 | 12.1 | 1.1 | 2.1 | 9 | A |
| | 12 | 7.2 | 2.1 | 1.7 | 5 | A |
| | 13 | 6.0 | 1.1 | 1.8 | 4 | A |
| | 14 | 7.1 | 1.1 | 1.7 | 5 | A |
| | 15 | 8.3 | 1.1 | 1.8 | 7 | A |
| | 16 | 7.0 | 2.2 | 1.7 | 5 | A |
| | 17 | 7.4 | 1.3 | 1.7 | 5 | A |
| | 18 | 8.1 | 1.4 | 1.8 | 7 | A |
| | 19 | 11.5 | 2.3 | 2.0 | 8 | A |
| | 20 | 13.2 | 1.2 | 1.9 | 8 | A |

TABLE 2-1-continued

| | | | | | |
|---|---|---|---|---|---|
| 21 | 7.2 | 1.2 | 1.8 | 4 | A |
| 22 | 8.0 | 2.1 | 1.8 | 8 | A |
| 23 | 8.8 | 1.6 | 1.9 | 4 | A |
| 24 | 15.3 | 1.0 | 2.2 | 2 | A |
| 25 | 7.0 | 2.1 | 1.9 | 5 | A |
| 26 | 7.5 | 1.1 | 1.9 | 3 | A |
| 27 | 7.2 | 1.2 | 1.8 | 4 | A |

TABLE 2-2

| | | | Hot-Rolling Condition | | | | | | | | |
|---|---|---|---|---|---|---|---|---|---|---|---|
| | No. | Steel No. | heating temperature ° C. | total rolling reduction in Rough rolling % | rolling pass number in Rough rolling | rolling pass number with rolling reduction of 30% or more in Rough rolling | Rough Rolling End temperature° C. | total rolling reduction in finish rolling % | Rough rolling reduction/finish rolling reduction | Finish Temperature ° C. | Coiling Temperature ° C. |
| Comparative Example | 28 | B1 | 1120 | 89 | 7 | 5 | 1020 | 82 | 1.1 | 830 | 640 |
| | 29 | B2 | 1120 | 87 | 7 | 5 | 1050 | 80 | 1.1 | 850 | 600 |
| | 30 | B3 | 1160 | 90 | 7 | 5 | 1050 | 82 | 1.1 | 820 | 580 |
| | 31 | B4 | 1160 | 89 | 7 | 6 | 1060 | 78 | 1.1 | 750 | 550 |
| | 32 | B5 | 1160 | 89 | 7 | 6 | 1010 | 82 | 1.1 | 800 | 630 |
| | 33 | B6 | 1120 | 89 | 7 | 5 | 1010 | 80 | 1.1 | 840 | 640 |
| | 34 | B7 | 1200 | 88 | 5 | 3 | 1020 | 82 | 1.1 | 830 | 600 |
| | 35 | B8 | 1120 | 89 | 7 | 5 | 1030 | 80 | 1.1 | 830 | 640 |
| | 36 | B9 | 1120 | 93 | 7 | 5 | 1020 | 78 | 1.2 | 850 | 600 |
| | 37 | B10 | 1160 | 88 | 7 | 5 | 1050 | 82 | 1.1 | 820 | 580 |
| | 38 | B11 | 1160 | 89 | 7 | 6 | 1010 | 70 | 1.3 | 750 | 550 |
| | 39 | B12 | 1160 | 92 | 7 | 5 | 1050 | 82 | 1.1 | 820 | 580 |
| | 40 | B13 | 1200 | 85 | 5 | 3 | 1010 | 80 | 1.1 | 850 | 610 |
| | 41 | B14 | 1200 | 89 | 5 | 3 | 1030 | 82 | 1.1 | 830 | 600 |
| | 42 | B15 | 1120 | 89 | 7 | 5 | 1060 | 78 | 1.1 | 830 | 640 |
| | 43 | B16 | 1120 | 90 | 7 | 5 | 1010 | 82 | 1.1 | 850 | 600 |
| | 44 | B17 | 1200 | 89 | 5 | 3 | 1030 | 82 | 1.1 | 830 | 600 |
| | 45 | B18 | 1120 | 91 | 7 | 5 | 1020 | 80 | 1.1 | 830 | 640 |
| | 46 | B19 | 1120 | 93 | 7 | 5 | 1030 | 82 | 1.1 | 850 | 600 |
| | 47 | B20 | 1120 | 88 | 7 | 5 | 1060 | 78 | 1.1 | 850 | 600 |
| | 48 | B21 | 1120 | 89 | 7 | 5 | 1050 | 82 | 1.1 | 830 | 640 |

| | | Intermediate Rolling | | Intermediate Annealing | | | Final Annealing | |
|---|---|---|---|---|---|---|---|---|
| | | | | Annealing | | | Annealing | |
| | No. | Roll Diameter mm | Rolling Reduction % | Temperature ° C. | (111)Orientation Intensity | Grain size number | Temperature ° C. | Grain size number |
| Comparative Example | 28 | 500 | 44 | 850 | 3.2 | 7.1 | 900 | 7.5 |
| | 29 | 500 | 44 | 870 | 4.2 | 7.5 | 910 | 6.5 |
| | 30 | 500 | 55 | 870 | 3.1 | 7.7 | 900 | 6.1 |
| | 31 | 500 | 55 | 850 | 7.2 | 6.5 | 890 | 5.6 |
| | 32 | 450 | 46 | 830 | 5.4 | 7.4 | 900 | 5.7 |
| | 33 | 450 | 46 | 835 | 3.3 | 6.3 | 920 | 6.2 |
| | 34 | 400 | 44 | 850 | 6.1 | 6.8 | 925 | 6.0 |
| | 35 | 500 | 44 | 850 | 3.2 | 7.2 | 900 | 7.2 |
| | 36 | 500 | 44 | 870 | 4.1 | 7.5 | 910 | 6.5 |
| | 37 | 500 | 55 | 870 | 3.2 | 7.5 | 900 | 5.2 |
| | 38 | 500 | 55 | 850 | 7.1 | 8.1 | 890 | 7.5 |
| | 39 | 500 | 55 | 870 | 2.1 | 5.5 | 900 | 5.4 |
| | 40 | 400 | 44 | 850 | 3.0 | 7.2 | 940 | 7.0 |
| | 41 | 400 | 44 | 835 | 2.3 | 6.5 | 900 | 7.0 |
| | 42 | 500 | 44 | 850 | 1.0 | 6.2 | 910 | 6.5 |
| | 43 | 500 | 44 | 850 | 3.2 | 6.1 | 900 | 5.2 |
| | 44 | 400 | 44 | 870 | 4.1 | 6.3 | 900 | 7.0 |
| | 45 | 500 | 44 | 870 | 2.3 | 6.5 | 910 | 4.5 |
| | 46 | 500 | 44 | 835 | 3.1 | 6.0 | 900 | 5.9 |
| | 47 | 500 | 44 | 850 | 2.0 | 4.5 | 900 | 4.8 |
| | 48 | 500 | 44 | 850 | 2.1 | 6.5 | 910 | 4.5 |

TABLE 2-2-continued

| | | Characteristics of Product Sheet | | | | |
|---|---|---|---|---|---|---|
| | No. | (111)Orientation Intensity | (411)Orientation Intensity | Average r-value | Ridging Height μm | Result of Pipe Expansion Test |
| Comparative Example | 28 | 4.0* | 1.1 | 1.4* | 4 | X |
| | 29 | 3.1* | 1.2 | 1.2* | 25* | X |
| | 30 | 3.0* | 5.4* | 1.0* | 20* | X |
| | 31 | 6.0 | 4.3* | 1.5* | 23* | X |
| | 32 | 7.4 | 4.3* | 1.4* | 5 | X |
| | 33 | 6.0 | 3.4* | 1.6* | 5 | X |
| | 34 | 2.0* | 1.1 | 1.0* | 6 | X |
| | 35 | 4.3* | 4.3* | 1.0* | 8 | X |
| | 36 | 3.0* | 4.3* | 0.8* | 12* | X |
| | 37 | 3.0* | 4.2* | 0.8* | 21* | X |
| | 38 | 6.1 | 4.2* | 1.2* | 4 | X |
| | 39 | 4.0* | 1.1 | 1.3* | 25* | X |
| | 40 | 10.1 | 7.0* | 0.8* | 20* | X |
| | 41 | 2.1* | 4.0* | 1.1* | 20* | X |
| | 42 | 3.3* | 2.2 | 1.2* | 18* | X |
| | 43 | 3.0* | 1.3 | 1.2* | 6 | X |
| | 44 | 2.3* | 1.2 | 1.1* | 8 | X |
| | 45 | 2.1* | 1.0 | 0.9* | 10* | X |
| | 46 | 1.0* | 1.1 | 0.7* | 5 | X |
| | 47 | 2.0* | 2.0 | 0.8* | 10* | X |
| | 48 | 2.1* | 1.3 | 0.9* | 10* | X |

*Out of the scope of the invention

TABLE 2-3

| | | | Hot-Rolling Condition | | | | | | | | |
|---|---|---|---|---|---|---|---|---|---|---|---|
| | No. | Steel No. | heating temperature ° C. | total rolling reduction in Rough rolling % | rolling pass number in Rough rolling | rolling pass number with rolling reduction of 30% or more in Rough rolling | Rough Rolling End temperature ° C. | total rolling reduction in finish rolling % | Rough rolling reduction/finish rolling reduction | Finish Temperature ° C. | Coiling Temperature ° C. |
| Comparative Example | 49 | B22 | 1120 | 92 | 7 | 5 | 1020 | 80 | 1.2 | 850 | 600 |
| | 50 | B23 | 1160 | 85 | 7 | 5 | 1060 | 80 | 1.1 | 820 | 580 |
| | 51 | B24 | 1200 | 89 | 5 | 3 | 1010 | 80 | 1.1 | 830 | 600 |
| | 52 | B25 | 1120 | 89 | 7 | 5 | 1010 | 78 | 1.1 | 830 | 640 |
| | 53 | A1 | 1250* | 90 | 7 | 5 | 1020 | 82 | 1.1 | 830 | 630 |
| | 54 | A1 | 1050* | 89 | 7 | 5 | 1020 | 80 | 1.1 | 850 | 620 |
| | 55 | A1 | 1120 | 85 | 7 | 4* | 1020 | 95 | 0.9 | 770 | 580 |
| | 56 | A1 | 1120 | 89 | 7 | 4* | 1020 | 90 | 1.0 | 800 | 590 |
| | 57 | A1 | 1160 | 90 | 7 | 1* | 1020 | 82 | 1.1 | 800 | 630 |
| | 58 | A1 | 1160 | 89 | 7 | 4* | 1020 | 80 | 1.1 | 830 | 640 |
| | 59 | A1 | 1120 | 91 | 7 | 5 | 1020 | 82 | 1.1 | 940* | 650 |
| | 60 | A1 | 1120 | 93 | 7 | 5 | 1020 | 80 | 1.2 | 820 | 750* |
| | 61 | A1 | 1160 | 88 | 5 | 4 | 1020 | 78 | 1.1 | 800 | 550 |
| | 62 | A1 | 1120 | 89 | 7 | 5 | 1020 | 82 | 1.1 | 840 | 630 |
| | 63 | A1 | 1200 | 92 | 7 | 6 | 1020 | 80 | 1.2 | 830 | 640 |
| | 64 | A1 | 1120 | 89 | 7 | 6 | 1020 | 82 | 1.1 | 850 | 600 |
| | 65 | A1 | 1120 | 92 | 7 | 5 | 1020 | 78 | 1.2 | 830 | 590 |
| | 66 | A1 | 1160 | 85 | 7 | 5 | 1020 | 80 | 1.1 | 850 | 630 |
| | 67 | A1 | 1120 | 89 | 7 | 5 | 980* | 82 | 1.1 | 830 | 640 |

| | | Intermediate | | Intermediate Annealing | | | Final Annealing | |
|---|---|---|---|---|---|---|---|---|
| | | Rolling | | Annealing | | | Annealing | |
| | No. | Roll Diameter mm | Rolling Reduction % | Temperature ° C. | (111)Orientation Intensity | Grain size number | Temperature ° C. | Grain size number |
| Comparative Example | 49 | 500 | 44 | 870 | 3.0 | 6.0 | 900 | 5.9 |
| | 50 | 500 | 55 | 870 | 2.3 | 4.7 | 900 | 4.8 |
| | 51 | 400 | 44 | 835 | 1.0 | 6.5 | 900 | 7.0 |

TABLE 2-3-continued

| | | | | | | | |
|---|---|---|---|---|---|---|---|
| 52 | 500 | 44 | 850 | 1.1 | 6.2 | 910 | 6.5 |
| 53 | 500 | 44 | 850 | 3.4 | 7.7 | 900 | 7.1 |
| 54 | 500 | 44 | 850 | 6.2 | 7.3 | 900 | 6.5 |
| 55 | 500 | 50 | 870 | 5.4 | 6.9 | 900 | 5.8 |
| 56 | 500 | 50 | 870 | 4.3 | 8.5 | 910 | 7.3 |
| 57 | 450 | 55 | 840 | 6.1 | 7.5 | 890 | 7.7 |
| 58 | 450 | 55 | 840 | 7.2 | 7.5 | 920 | 7.2 |
| 59 | 400 | 55 | 830 | 5.2 | 7.1 | 890 | 6.5 |
| 60 | 400 | 55 | 850 | 3.1 | 7.3 | 900 | 5.4 |
| 61 | 100* | 44 | 850 | 4.0 | 7.9 | 920 | 5.8 |
| 62 | 500 | 35* | 850 | 8.0 | 7.8 | 925 | 6.3 |
| 63 | 500 | 55 | 900* | 2.0 | 5.5 | 940 | 6.2 |
| 64 | 450 | 46 | 770* | 1.1 | 4.8 | 900 | 7.5 |
| 65 | 500 | 44 | 850 | 3.1 | 7.5 | 960* | 5 |
| 66 | 500 | 50 | 850 | 3.0 | 8.5 | 800* | non-recrys-tallized |
| 67 | 500 | 44 | 850 | 2.6 | 7.0 | 900 | 7.0 |

| | | Characteristics of Product Sheet | | | | |
|---|---|---|---|---|---|---|
| | No. | (111)Orient-ation Intensity | (411)Orient-ation Intensity | Average r-value | Ridging Height μm | Result of Pipe Expansion Test |
| Comparative Example | 49 | 1.2* | 1.1 | 0.7* | 5 | X |
| | 50 | 2.3* | 2.1 | 0.8* | 10* | X |
| | 51 | 2.0* | 4.1* | 0.9* | 21* | X |
| | 52 | 3.0* | 2.1 | 1.1* | 19* | X |
| | 53 | 4.4* | 1.1 | 1.5* | 5 | X |
| | 54 | 6.1 | 4.0* | 1.2* | 13* | X |
| | 55 | 6.2 | 4.0* | 1.5* | 12* | X |
| | 56 | 4.0* | 4.0* | 1.4* | 21* | X |
| | 57 | 3.0* | 1.1 | 1.1* | 20* | X |
| | 58 | 3.0* | 1.2 | 1.1* | 20* | X |
| | 59 | 6.1 | 5.2* | 1.4* | 18* | X |
| | 60 | 7.3 | 4.1* | 1.6* | 25* | X |
| | 61 | 3.0* | 2.2 | 1.4* | 10* | X |
| | 62 | 4.0* | 1.1 | 1.2* | 5 | X |
| | 63 | 7.2 | 5.1* | 1.4* | 4 | X |
| | 64 | 4.1* | 1.1 | 1.2* | 25* | X |
| | 65 | 10.1 | 4.0* | 1.7 | 20* | X |
| | 66 | 2.0* | 2.1 | 1.1* | 23* | X |
| | 67 | 5.5 | 3.3* | 1.6* | 11* | X |

*Out of the scope of the invention

It is clear that the steel according to the above exemplary embodiment exhibits a high r-value and low ridging height and is excellent in pressing formability. Tables 2-1 to 2-3 show the results of pipe expansion test of an ERW steel pipe made of the steel sheet. The pipe expansion test was performed using a 60 degrees cone, where an end of the pipe is expanded to a double of a diameter of the non-expanded pipe (2D pipe expansion). When the pipe is not cracked, the test result is evaluated as A. When the pipe is cracked, the test results is evaluated as X. The results show that the steel pipes of the first exemplary embodiment have excellent formability.

Examples for the above-described second exemplary embodiment will be described below.

Steels of compositions shown in Tables 3-1 and 3-2 were melted and cast into a slab. After the slab was subjected to hot rolling until the thickness of the slab became 5 mm thick, the steels were subjected to hot rolling, (without applying the annealing of hot-rolled sheet: annealing of hot-rolled sheet was applied in some of Comparative Examples), intermediate cold rolling, intermediate annealing, finish cold rolling and finish annealing to obtain product sheets having various thicknesses. The steels were manufactured under the conditions shown in Tables 4-1 to 4-3.

Herein, in order to measure the texture, (200), (110) and (211) pole figures of the sheet-thickness central area (exposing the central area by a combination of mechanical polishing and electropolishing) were obtained using an X-ray diffractometer (manufactured by Rigaku Corporation) and Mo-Kα ray to obtain an ODF (Orientation Distribution Function) based on the dot diagrams using a spherical harmonics method. Based on the measurement results, {111}<110>-orientation intensity and {311}<136>-orientation intensity were calculated.

In order to evaluate the average r-value ($r_m$), JIS13B tensile test pieces were taken from a product sheet and the average r-value was calculated using formulae (3) and (4) below after applying 14.4% distortions in a rolling direction, a 45-degree direction with respect to the rolling direction and a direction perpendicular to the rolling direction.

$$r=\ln(W_0/W)/\ln(t_0/t) \quad (3)$$

In the formula (3), $W_0$ represents a sheet width before applying a tensile force, W represents a sheet width after applying the tensile force, $t_0$ represents a sheet thickness before applying the tensile force and t represents a sheet thickness after applying the tensile force.

$$r_m=(r_0+2r_{45}+r_{90})/4 \quad (4)$$

In the formula (4), $r_m$ represents an average r-value, $r_0$ represents an r-value in the rolling direction, $r_{45}$ represents an r-value in the 45-degree direction with respect to the rolling direction and $r_{90}$ represents an r-value in the direction perpendicular to the rolling direction.

Tables 4-1 to 4-3 show the results of pipe expansion test of an ERW steel pipe made of the steel sheet. The pipe expansion test was performed using a 60 degrees cone, where an end of the pipe is expanded to a double of a diameter of the non-expanded pipe (2D pipe expansion). When the pipe is not cracked, the test result is evaluated as A. When the pipe is cracked, the test results is evaluated as X.

TABLE 3-1

| Steel | | Composition (mass %) | | | | | | | | | | |
|---|---|---|---|---|---|---|---|---|---|---|---|---|
| | No. | C | N | Si | Mn | P | S | Cr | Ti | Nb | B | Al |
| Exemplary Embodiment | 1 | 0.004 | 0.007 | 0.42 | 0.32 | 0.02 | 0.0005 | 10.7 | 0.16 | — | — | 0.05 |
| | 2 | 0.005 | 0.003 | 0.45 | 1.41 | 0.01 | 0.0008 | 10.9 | 0.19 | — | 0.0002 | 0.05 |
| | 3 | 0.005 | 0.004 | 0.42 | 0.66 | 0.02 | 0.0004 | 11.3 | 0.21 | — | — | 0.07 |
| | 4 | 0.005 | 0.004 | 0.32 | 0.66 | 0.03 | 0.0004 | 10.9 | 0.21 | — | 0.002 | 0.07 |
| | 5 | 0.012 | 0.002 | 0.41 | 1.43 | 0.02 | 0.0009 | 19.0 | 0.12 | 0.28 | — | 0.06 |
| | 6 | 0.012 | 0.002 | 0.41 | 1.43 | 0.02 | 0.0009 | 19.0 | — | 0.32 | — | 0.06 |
| | 7 | 0.004 | 0.004 | 0.28 | 0.67 | 0.02 | 0.0009 | 11.0 | 0.19 | — | — | 0.06 |
| | 8 | 0.017 | 0.002 | 0.41 | 0.65 | 0.03 | 0.0009 | 14.2 | 0.19 | — | — | 0.08 |
| | 9 | 0.007 | 0.004 | 0.43 | 0.27 | 0.02 | 0.0010 | 11.0 | 0.22 | — | — | 0.21 |
| | 10 | 0.009 | 0.003 | 0.44 | 0.64 | 0.03 | 0.0013 | 13.1 | 0.20 | — | — | 0.12 |
| | 11 | 0.011 | 0.005 | 0.42 | 0.57 | 0.04 | 0.0010 | 11.0 | 0.22 | — | — | 0.06 |
| | 12 | 0.005 | 0.009 | 0.45 | 0.37 | 0.02 | 0.0008 | 14.3 | 0.15 | — | — | 0.07 |
| | 13 | 0.004 | 0.003 | 0.43 | 0.35 | 0.01 | 0.0013 | 25.1 | 0.29 | — | — | 0.13 |
| | 14 | 0.006 | 0.005 | 0.66 | 2.52 | 0.03 | 0.0080 | 27.0 | 0.14 | 0.45 | — | 0.09 |
| | 15 | 0.011 | 0.011 | 0.80 | 0.33 | 0.02 | 0.0032 | 18.1 | 0.14 | — | — | 0.09 |
| | 16 | 0.011 | 0.026 | 0.62 | 1.57 | 0.02 | 0.0017 | 11.5 | 0.24 | 0.44 | — | 0.09 |
| | 17 | 0.025 | 0.015 | 0.62 | 0.64 | 0.03 | 0.0013 | 18.1 | 0.14 | — | — | 0.09 |
| | 18 | 0.004 | 0.008 | 0.41 | 0.31 | 0.03 | 0.0005 | 10.7 | 0.17 | — | — | 0.05 |
| | 19 | 0.005 | 0.007 | 0.43 | 0.33 | 0.03 | 0.0005 | 10.8 | 0.15 | — | — | 0.05 |
| | 20 | 0.004 | 0.007 | 0.41 | 0.30 | 0.03 | 0.0005 | 10.6 | 0.19 | — | — | 0.05 |
| | 21 | 0.005 | 0.007 | 0.42 | 0.21 | 0.03 | 0.0005 | 10.9 | 0.19 | — | — | 0.05 |

| Steel | | Composition (mass %) | | | | | |
|---|---|---|---|---|---|---|---|
| | No. | Ni | Mo | Cu | V | Mg | Others |
| Exemplary Embodiment | 1 | — | — | — | — | — | — |
| | 2 | — | — | — | — | — | — |
| | 3 | 0.16 | — | — | — | — | — |
| | 4 | — | — | — | — | — | — |
| | 5 | — | — | — | — | — | — |
| | 6 | — | 1.50 | — | — | — | — |
| | 7 | 0.35 | — | 0.78 | — | — | — |
| | 8 | — | — | — | 0.19 | 0.0005 | — |
| | 9 | — | — | — | — | — | Sn: 0.1 |
| | 10 | — | — | — | — | — | Zr: 0.03 |
| | 11 | — | — | — | — | — | W: 1.5 |
| | 12 | — | — | — | — | — | Co: 0.05 |
| | 13 | — | — | — | — | — | Sb: 0.45 |
| | 14 | — | — | — | — | — | REM: 0.11 |
| | 15 | — | — | — | 0.7 | 0.0022 | W: 2.6 |
| | 16 | 0.7 | — | — | — | — | Co: 0.23 |
| | 17 | — | — | 2.6 | — | — | — |
| | 18 | — | — | — | — | — | Ca: 0.0010 |
| | 19 | — | — | — | — | — | Ga: 0.0020 |
| | 20 | — | — | — | — | — | Hf: 0.005 |
| | 21 | — | — | — | — | — | Ta: 0.006 |

TABLE 3-2

| Steel | | Composition (mass %) | | | | | | | | | | |
|---|---|---|---|---|---|---|---|---|---|---|---|---|
| | No. | C | N | Si | Mn | P | S | Cr | Ti | Nb | B | Al |
| Comparative Example | 22 | 0.004 | 0.007 | 0.42 | 0.32 | 0.02 | 0.0006 | 10.7 | 0.16 | — | *0.0101 | 0.05 |
| | 23 | 0.007 | 0.005 | 0.46 | 0.27 | 0.03 | 0.0005 | 10.8 | 0.17 | — | — | 0.06 |
| | 24 | 0.011 | 0.007 | 0.43 | 0.32 | 0.02 | 0.0012 | 14.2 | 0.16 | 0.32 | — | 0.06 |
| | 25 | 0.004 | 0.003 | 0.42 | 0.32 | 0.02 | 0.0005 | 10.9 | 0.12 | — | — | 0.06 |
| | 26 | 0.005 | 0.003 | 0.41 | 0.70 | 0.01 | 0.0008 | 10.7 | 0.16 | — | — | 0.06 |
| | 27 | 0.004 | 0.007 | 0.54 | 0.51 | 0.04 | 0.0010 | 17.3 | 0.15 | — | — | 0.05 |
| | 28 | 0.021 | 0.003 | 0.42 | 0.32 | 0.02 | 0.0013 | 11.3 | — | 0.38 | — | 0.07 |
| | 29 | 0.005 | 0.004 | 0.98 | 0.27 | 0.02 | 0.0010 | 13.6 | 0.18 | — | — | 0.05 |
| | 30 | 0.007 | 0.007 | 0.59 | 0.50 | 0.03 | 0.0020 | 14.1 | 0.21 | — | — | 0.12 |
| | 31 | 0.004 | 0.007 | 0.42 | 0.38 | 0.02 | 0.0011 | 13.4 | 0.16 | — | — | 0.08 |
| | 32 | 0.005 | 0.004 | 0.42 | 0.32 | 0.03 | 0.0014 | 11.4 | *— | *— | — | 0.07 |
| | 33 | 0.007 | 0.005 | *2.17 | 0.66 | 0.02 | 0.0020 | 14.1 | 0.22 | 0.48 | — | 0.13 |
| | 34 | 0.004 | 0.006 | 0.61 | 0.53 | 0.04 | 0.0011 | 21.4 | *0.19 | *0.56 | — | 0.11 |

TABLE 3-2-continued

| | | | | | | | | | | | |
|---|---|---|---|---|---|---|---|---|---|---|---|
| 35 | 0.005 | 0.004 | 0.46 | *3.52 | 0.03 | 0.0006 | 13.4 | 0.21 | — | — | 0.06 |
| 36 | *0.031 | 0.021 | 0.72 | 0.65 | 0.03 | 0.0011 | 11.1 | 0.16 | 0.21 | — | 0.08 |
| 37 | 0.025 | *0.033 | 0.68 | 0.51 | *0.05 | 0.0013 | 10.2 | 0.15 | 0.22 | — | 0.06 |
| 38 | 0.010 | 0.008 | 0.28 | 0.26 | 0.02 | 0.0018 | 19.1 | — | *0.82 | 0.0003 | 0.05 |
| 39 | 0.009 | 0.010 | 0.68 | 0.12 | 0.04 | 0.0011 | 17.2 | *1.21 | — | 0.0002 | 0.06 |

| | Steel No. | Composition (mass %) | | | | | |
|---|---|---|---|---|---|---|---|
| | | Ni | Mo | Cu | V | Mg | Others |
| Comparative Example | 22 | — | — | — | — | — | — |
| | 23 | *1.5 | — | — | — | — | — |
| | 24 | — | *2.5 | — | — | — | — |
| | 25 | — | — | *3.1 | — | — | — |
| | 26 | — | — | — | *1.23 | — | — |
| | 27 | — | — | — | — | *0.0145 | — |
| | 28 | — | — | — | — | — | Sn: *0.51 |
| | 29 | — | — | — | — | — | Zr: *0.51 |
| | 30 | — | — | — | — | — | W: *3.1 |
| | 31 | — | — | — | — | — | Co: *0.48 |
| | 32 | — | — | — | — | — | — |
| | 33 | 0.1 | — | 1.5 | — | — | — |
| | 34 | — | — | 0.2 | — | — | — |
| | 35 | 0.35 | — | — | — | — | — |
| | 36 | — | — | — | — | — | — |
| | 37 | — | — | — | — | — | — |
| | 38 | — | 1.1 | — | — | — | — |
| | 39 | — | — | — | — | — | — |

*Out of the scope of the invention

TABLE 4-1

| | | | Hot-Rolling Condition | | | | | Hot-Rolling | Intermediate | | Intermediate |
|---|---|---|---|---|---|---|---|---|---|---|---|
| | | | Heating | Finish Rolling Temperature (° C.) | | | Coiling | Annealing Annealing | Cold Rolling | | Annealing Annealing |
| | No | Steel No. | Temperature ° C. | Start | End | Difference | Temperature ° C. | Temperature ° C. | Roll Diameter mm | Rolling Reduction % | Temperature ° C. |
| Exemplary Embodiment | A1 | 1 | 1135 | 960 | 810 | 150 | 630 | — | 500 | 44 | 825 |
| | A2 | 1 | 1135 | 960 | 810 | 150 | 630 | — | 500 | 44 | 850 |
| | A3 | 1 | 1135 | 960 | 810 | 150 | 630 | — | 500 | 44 | 875 |
| | A4 | 1 | 1135 | 960 | 810 | 150 | 630 | — | 500 | 44 | 850 |
| | A5 | 1 | 1135 | 960 | 810 | 150 | 630 | — | 500 | 44 | 850 |
| | A6 | 1 | 1135 | 960 | 810 | 150 | 630 | — | 500 | 44 | 850 |
| | A7 | 1 | 1135 | 960 | 810 | 150 | 630 | — | 105 | 44 | 850 |
| | A8 | 2 | 1135 | 960 | 840 | 120 | 640 | — | 500 | 44 | 850 |
| | A9 | 3 | 1120 | 950 | 820 | 130 | 620 | — | 500 | 45 | 875 |
| | A10 | 4 | 1135 | 960 | 840 | 120 | 630 | — | 500 | 44 | 875 |
| | A11 | 5 | 1135 | 960 | 840 | 120 | 630 | — | 500 | 44 | 875 |
| | A12 | 6 | 1160 | 980 | 880 | 100 | 650 | — | 500 | 51 | 880 |
| | A13 | 7 | 1160 | 980 | 880 | 100 | 650 | — | 500 | 46 | 880 |
| | A14 | 8 | 1160 | 980 | 880 | 100 | 650 | — | 500 | 52 | 880 |
| | A15 | 9 | 1135 | 960 | 840 | 120 | 630 | — | 500 | 44 | 845 |
| | A16 | 10 | 1120 | 950 | 830 | 120 | 620 | — | 500 | 50 | 845 |
| | A17 | 11 | 1135 | 960 | 840 | 120 | 630 | — | 500 | 50 | 875 |
| | A18 | 12 | 1140 | 970 | 890 | 80 | 660 | — | 500 | 50 | 875 |
| | A19 | 13 | 1180 | 980 | 880 | 100 | 650 | — | 100 | 44 | 825 |
| | A20 | 14 | 1180 | 980 | 880 | 100 | 650 | — | 500 | 51 | 850 |
| | A21 | 15 | 1180 | 980 | 880 | 100 | 680 | — | 105 | 44 | 850 |
| | A22 | 16 | 1190 | 990 | 880 | 110 | 710 | — | 500 | 51 | 875 |
| | A23 | 17 | 1170 | 980 | 870 | 110 | 650 | — | 500 | 51 | 850 |
| | A24 | 18 | 1135 | 960 | 810 | 150 | 630 | — | 500 | 44 | 825 |
| | A25 | 19 | 1135 | 960 | 810 | 150 | 630 | — | 500 | 44 | 825 |
| | A26 | 20 | 1135 | 960 | 810 | 150 | 630 | — | 500 | 44 | 825 |
| | A27 | 21 | 1135 | 960 | 810 | 150 | 630 | — | 500 | 44 | 825 |

TABLE 4-1-continued

| | | Intermediate Annealing | | Finish Cold rolling | | Final Annealing Annealing | | Orientation Intensity | |
|---|---|---|---|---|---|---|---|---|---|
| | No | (111)Orientation Intensity | Grain size number | Roll Diameter mm | Rolling Reduction % | Temperature ° C. | Grain size number | (111)Orientation Intensity | (311)Orientation Intensity |
| Exemplary Embodiment | A1 | 5 | — | 100 | 61 | 900 | 8 | 5.2 | 2.0 |
| | A2 | 5 | — | 100 | 61 | 900 | 8 | 6.3 | 2.0 |
| | A3 | 5 | 6 | 100 | 60 | 900 | 8 | 6.6 | 2.1 |
| | A4 | 5 | — | 100 | 71 | 900 | 8 | 9.1 | 2.1 |
| | A5 | 5 | — | 105 | 82 | 900 | 8 | 16.3 | 2.2 |
| | A6 | 5 | — | 105 | 89 | 900 | 9 | 23.6 | 2.3 |
| | A7 | 4 | 7 | 400 | 62 | 925 | 7 | 5.3 | 2.0 |
| | A8 | 5 | 6 | 80 | 60 | 900 | 8 | 6.2 | 2.1 |
| | A9 | 6 | 6 | 80 | 60 | 900 | 8 | 6.0 | 2.0 |
| | A10 | 6 | 7 | 80 | 60 | 950 | 7 | 5.0 | 1.4 |
| | A11 | 6 | 7 | 100 | 60 | 950 | 7 | 6.3 | 2.0 |
| | A12 | 5 | 7 | 80 | 70 | 900 | 8 | 6.9 | 2.1 |
| | A13 | 5 | 7 | 80 | 63 | 900 | 8 | 7.1 | 2.3 |
| | A14 | 5 | — | 80 | 71 | 900 | 8 | 9.0 | 2.1 |
| | A15 | 5 | 7 | 80 | 64 | 900 | 8 | 6.7 | 2.5 |
| | A16 | 5 | 7 | 100 | 64 | 900 | 8 | 8.3 | 2.2 |
| | A17 | 5 | 7 | 100 | 64 | 925 | 8 | 9.2 | 2.0 |
| | A18 | 5 | 6 | 100 | 64 | 925 | 8 | 8.1 | 2.0 |
| | A19 | 5 | — | 400 | 70 | 900 | 8 | 6.7 | 2.2 |
| | A20 | 5 | 7 | 80 | 70 | 900 | 8 | 6.0 | 2.6 |
| | A21 | 5 | 7 | 400 | 82 | 900 | 8 | 10.3 | 2.8 |
| | A22 | 6 | — | 400 | 60 | 900 | 8 | 7.4 | 2.4 |
| | A23 | 5 | 7 | 105 | 82 | 900 | 8 | 12.1 | 2.6 |
| | A24 | 5 | — | 100 | 61 | 900 | 8 | 5.3 | 2.0 |
| | A25 | 5 | — | 100 | 61 | 900 | 8 | 5.2 | 2.1 |
| | A26 | 5 | — | 100 | 61 | 900 | 8 | 5.1 | 2.1 |
| | A27 | 5 | — | 100 | 61 | 900 | 8 | 5.1 | 2.1 |

| | | Characteristics of Product Sheet | | | Result |
|---|---|---|---|---|---|
| | No | Average r-value $r_m$ | Sheet Thickness t mm | "−t + 3" | of Pipe Expansion Test |
| Exemplary Embodiment | A1 | 1.8 | 1.2 | 1.8 | A |
| | A2 | 1.9 | 1.2 | 1.8 | A |
| | A3 | 1.9 | 1.2 | 1.8 | A |
| | A4 | 2.3 | 0.8 | 2.2 | A |
| | A5 | 2.6 | 0.5 | 2.5 | A |
| | A6 | 3.1 | 0.3 | 2.7 | A |
| | A7 | 1.8 | 1.2 | 1.8 | A |
| | A8 | 2.3 | 1.2 | 1.8 | A |
| | A9 | 1.8 | 1.2 | 1.8 | A |
| | A10 | 2.3 | 1.2 | 1.8 | A |
| | A11 | 1.9 | 1.2 | 1.8 | A |
| | A12 | 2.3 | 0.8 | 2.2 | A |
| | A13 | 2.5 | 1.0 | 2.0 | A |
| | A14 | 2.3 | 0.8 | 2.2 | A |
| | A15 | 1.9 | 1.0 | 2.0 | A |
| | A16 | 2.1 | 1.0 | 2.0 | A |
| | A17 | 2.2 | 1.0 | 2.0 | A |
| | A18 | 2.3 | 1.0 | 2.0 | A |
| | A19 | 2.2 | 0.8 | 2.2 | A |
| | A20 | 1.9 | 1.2 | 1.8 | A |
| | A21 | 2.7 | 0.5 | 2.5 | A |
| | A22 | 2.0 | 1.2 | 1.8 | A |
| | A23 | 2.8 | 0.5 | 2.5 | A |
| | A24 | 1.7 | 1.2 | 1.8 | A |
| | A25 | 1.7 | 1.2 | 1.8 | A |
| | A26 | 1.7 | 1.2 | 1.8 | A |
| | A27 | 1.7 | 1.2 | 1.8 | A |

TABLE 4-2

| | | | Hot-Rolling Condition | | | | | Hot-Rolling Annealing | Intermediate | | Intermediate Annealing |
|---|---|---|---|---|---|---|---|---|---|---|---|
| | | | Heating | Finish Rolling | | | Coiling | Annealing | Cold Rolling | | Annealing |
| | | | Temper- | Temperature (° C.) | | | Temper- | Temper- | Roll | | Temper- |
| | No | Steel No. | ature ° C. | Start | End | Differ-ence | ature ° C. | ature ° C. | Diameter mm | Rolling Reduction % | ature ° C. |
| Comparative Example | B1 | 1 | 1135 | 960 | 810 | 150 | 630 | *950 | *105 | 44 | *1000 |
| | B2 | 1 | 1135 | 960 | 810 | 150 | 630 | *1000 | 400 | 44 | 875 |
| | B3 | 1 | 1135 | 960 | 810 | 150 | 630 | — | *— | *— | *— |
| | B4 | 1 | 1135 | 960 | 810 | 150 | 630 | — | 500 | 44 | *750 |
| | B5 | 1 | 1135 | 960 | 810 | 150 | 630 | — | 500 | 44 | *900 |
| | B6 | 1 | 1135 | 960 | 810 | 150 | 630 | — | 500 | 44 | *1000 |
| | B7 | 1 | 1135 | 990 | 810 | 180 | 650 | — | 500 | 44 | 850 |
| | B8 | 12 | 1140 | 970 | 890 | 80 | 660 | — | *100 | 50 | 875 |
| | B9 | 12 | *1050 | *880 | *790 | 90 | *580 | — | 400 | 50 | 850 |
| | B10 | 3 | *1080 | 900 | *770 | 130 | 600 | — | 500 | 45 | 875 |
| | B11 | 3 | *1250 | 1100 | 880 | *220 | 720 | — | 500 | 45 | 875 |
| | B12 | 3 | 1200 | 1060 | 840 | *220 | 670 | — | 500 | 45 | 875 |

| | | Intermediate | | Finish | | Final Annealing | | Orientation | |
|---|---|---|---|---|---|---|---|---|---|
| | | Annealing | | Cold rolling | | Annealing | | Intensity | |
| | No | (111)Orient-ation Intensity | Grain size number | Roll Diameter mm | Rolling Reduction % | Temper-ature ° C. | Grain size number | (111)Orient-ation Intensity | (311)Orient-ation Intensity |
| Comparative Example | B1 | 4 | 5 | *100 | 61 | 900 | 6 | *3.3 | 2.1 |
| | B2 | 5 | 5 | 100 | 61 | 900 | 8 | *3.8 | 2.3 |
| | B3 | — | — | 400 | 76 | 900 | 9 | 9.0 | *4.2 |
| | B4 | 6 | — | 100 | 61 | 900 | 8 | 4.1 | *3.4 |
| | B5 | 4 | 5 | 100 | 61 | 900 | 7 | *3.3 | 2.0 |
| | B6 | 6 | 5 | 100 | 61 | 900 | 6 | *2.4 | 1.0 |
| | B7 | 5 | — | 80 | 61 | *825 | — | 4.3 | *3.2 |
| | B8 | 5 | 6 | *60 | 64 | 925 | 7 | 6.5 | *4.1 |
| | B9 | 4 | — | 80 | 64 | 900 | 8 | 6.1 | *3.0 |
| | B10 | 4 | — | 80 | 60 | 900 | 8 | 5.1 | *3.4 |
| | B11 | 3 | — | 80 | 60 | 900 | 8 | *3.9 | *3.1 |
| | B12 | 4 | — | 80 | 60 | 900 | 8 | 5.5 | *3.1 |

| | | Characteristics of Product Sheet | | | Result |
|---|---|---|---|---|---|
| | No | Average r-value $r_m$ | Sheet Thickness t mm | "−t + 3" | of Pipe Expansion Test |
| Comparative Example | B1 | 1.4 | 1.2 | 1.8 | X |
| | B2 | 1.7 | 1.2 | 1.8 | X |
| | B3 | 1.7 | 1.2 | 1.8 | X |
| | B4 | 1.5 | 1.2 | 1.8 | X |
| | B5 | 1.6 | 1.2 | 1.8 | X |
| | B6 | 1.6 | 1.2 | 1.8 | X |
| | B7 | 1.4 | 1.2 | 1.8 | X |
| | B8 | 1.8 | 1.0 | 2.0 | X |
| | B9 | 1.8 | 1.0 | 2.0 | X |
| | B10 | 1.6 | 1.2 | 1.8 | X |
| | B11 | 1.5 | 1.2 | 1.8 | X |
| | B12 | 1.6 | 1.2 | 1.8 | X |

*Out of the scope of the invention

TABLE 4-3

| | | | Hot-Rolling Condition | | | | Hot-Rolling Annealing | | Intermediate Cold Rolling | | Intermediate Annealing |
|---|---|---|---|---|---|---|---|---|---|---|---|
| | | | Heating | Finish Rolling Temperature (° C.) | | | Coiling | Annealing | | | |
| | No | Steel No. | Temperature ° C. | Start | End | Difference | Temperature ° C. | Temperature ° C. | Roll Diameter mm | Rolling Reduction % | Temperature ° C. |
| Comparative Example | B13 | *22 | 1135 | 950 | 830 | 120 | 630 | — | 500 | 50 | 850 |
| | B14 | *23 | 1160 | 990 | 840 | 150 | 630 | — | 500 | 44 | 875 |
| | B15 | *24 | 1160 | 980 | 840 | 140 | 630 | — | 500 | 44 | 850 |
| | B16 | *25 | 1135 | 990 | 870 | 120 | 650 | — | 400 | 46 | 880 |
| | B17 | *26 | 1135 | 990 | 880 | 110 | 650 | — | 500 | 44 | 880 |
| | B18 | *27 | 1135 | 960 | 840 | 120 | 630 | — | *105 | 44 | 880 |
| | B19 | *28 | 1180 | 970 | 850 | 120 | 640 | *1050 | 400 | 45 | 875 |
| | B20 | *29 | 1170 | 960 | 850 | 110 | 640 | — | 500 | 53 | 875 |
| | B21 | *30 | 1135 | 960 | 830 | 130 | 630 | — | 400 | 46 | 825 |
| | B22 | *31 | 1140 | 960 | 830 | 130 | 630 | — | 400 | 44 | 825 |
| | B23 | *32 | 1135 | 960 | 830 | 130 | 630 | — | 500 | 44 | 850 |
| | B24 | *33 | 1200 | 1050 | 920 | 130 | 780 | — | 400 | 44 | 850 |
| | B25 | *34 | 1200 | 1050 | 930 | 120 | 790 | — | 400 | 63 | 875 |
| | B26 | *35 | 1200 | 1050 | 930 | 120 | 790 | — | 400 | 63 | 875 |
| | B27 | *36 | 1160 | 980 | 880 | 100 | 650 | — | 400 | 51 | 880 |
| | B28 | *37 | 1160 | 990 | 880 | 110 | 660 | — | 400 | 52 | 880 |
| | B29 | *38 | 1180 | 1020 | 940 | 80 | 790 | — | 400 | 44 | 880 |
| | B30 | *39 | 1180 | 1010 | 920 | 90 | 790 | — | 500 | 44 | 880 |

| | | Intermediate Annealing | | Finish Cold rolling | | Final Annealing | | Orientation Intensity | |
|---|---|---|---|---|---|---|---|---|---|
| | No | (111)Orientation Intensity | Grain size number | Roll Diameter mm | Rolling Reduction % | Temperature ° C. | Grain size number | (111)Orientation Intensity | (311)Orientation Intensity |
| Comparative Example | B13 | 4 | — | 100 | 82 | 950 | 5 | 5.8 | *5.5 |
| | B14 | 5 | 6 | 100 | 82 | 925 | 5 | 4.9 | *6.7 |
| | B15 | 5 | 7 | 80 | 82 | 950 | 5 | 6.2 | *4.0 |
| | B16 | 5 | 6 | 100 | 61 | 900 | 6 | *3.4 | 2.4 |
| | B17 | 4 | 6 | 80 | 61 | 900 | 6 | 4.0 | *3.5 |
| | B18 | 5 | 5 | *80 | 64 | 950 | 5 | 5.0 | *4.1 |
| | B19 | 5 | — | 80 | 64 | 925 | 6 | 4.3 | *5.0 |
| | B20 | 5 | 6 | 80 | 64 | 900 | 5 | 4.7 | *3.2 |
| | B21 | 5 | — | 80 | 82 | 900 | 6 | 5.1 | *4.3 |
| | B22 | 4 | — | 80 | 82 | 900 | 5 | 6.6 | *5.6 |
| | B23 | 3 | — | 100 | 61 | 900 | 4 | 4.1 | *3.2 |
| | B24 | 5 | — | 105 | *44 | *1050 | 5 | 8.2 | *5.5 |
| | B25 | 6 | — | 105 | 63 | *1000 | 6 | 11.1 | *6.1 |
| | B26 | 6 | — | 105 | 63 | 950 | 7 | 18.3 | *11.2 |
| | B27 | 5 | 7 | 80 | 70 | 975 | 7 | 5.1 | *4.7 |
| | B28 | 4 | — | 80 | 70 | 975 | 7 | 5.3 | *4.3 |
| | B29 | 6 | — | 60 | 60 | *1100 | 5 | 6.0 | *4.1 |
| | B30 | 5 | — | 80 | 61 | 975 | 7 | 5.3 | *4.6 |

| | | Characteristics of Product Sheet | | | Result |
|---|---|---|---|---|---|
| | No | Average r-value $r_m$ | Sheet Thickness t mm | "−t + 3" | of Pipe Expansion Test |
| Comparative Example | B13 | 1.4 | 0.8 | 2.2 | X |
| | B14 | 1.6 | 1.0 | 2.0 | X |
| | B15 | 1.8 | 0.8 | 2.2 | X |
| | B16 | 1.5 | 1.2 | 1.8 | X |
| | B17 | 1.1 | 1.2 | 1.8 | X |
| | B18 | 1.3 | 1.0 | 2.0 | X |
| | B19 | 1.4 | 1.0 | 2.0 | X |
| | B20 | 1.2 | 1.0 | 2.0 | X |
| | B21 | 1.4 | 0.8 | 2.2 | X |
| | B22 | 1.7 | 0.8 | 2.2 | X |
| | B23 | 1.4 | 1.2 | 1.8 | X |
| | B24 | 1.5 | 0.8 | 2.2 | X |
| | B25 | 1.7 | 0.3 | 2.7 | X |

TABLE 4-3-continued

| | | | | |
|---|---|---|---|---|
| B26 | 1.9 | 0.3 | 2.7 | X |
| B27 | 1.5 | 1.0 | 2.0 | X |
| B28 | 1.6 | 1.0 | 2.0 | X |
| B29 | 1.3 | 1.2 | 1.8 | X |
| B30 | 1.4 | 1.2 | 1.8 | X |

*Out of the scope of the invention

As is clear from Tables 3-1, 3-2 and 4-1 to 4-3, the steel of the exemplary embodiments of the invention satisfy a relationship between the average r-value and the sheet thickness of $r_m \geq -1.0t+3.0$, showing excellent press formability. Further, all of the results of 2D pipe expansion test are "A", which shows that the steel pipe of the exemplary embodiments of the invention have excellent formability.

The invention claimed is:

1. A ferritic stainless steel sheet with excellent formability, comprising:

0.03 mass % or less of C;
0.03 mass % or less of N;
1.0 mass % or less of Si;
3.0 mass % or less of Mn;
0.04 mass % or less of P;
0.0003 to 0.0100 mass % of S;
10 to 30 mass % of Cr;
0.300 mass % or less of Al;
one or both of 0.05 to 0.30 mass % of Ti and 0.01 to 0.50 mass % of Nb, a sum of Ti and Nb being in a range from smaller one of 8(C+N) and 0.05 to 0.75 mass %
and a residual amount of Fe and inevitable impurities, wherein
{111}<110>-orientation intensity is 4.0 or more and {311}<136>-orientation intensity is less than 3.0.

2. The ferritic stainless steel sheet according to claim 1, further comprising one or more of elements selected from the group consisting of: 0.0002 to 0.0030 mass % of B, 0.1 to 1.0 mass % of Ni, 0.1 to 2.0 mass % of Mo, 0.1 to 3.0 mass % of Cu, 0.05 to 1.00 mass % of V, 0.0002 to 0.0030 mass % of Ca, 0.0002 to 0.0030 mass % of Mg, 0.005 to 0.500 mass % of Sn, 0.01 to 0.30 mass % of Zr, 0.01 to 3.0 mass % of W, 0.01 to 0.30 mass % of Co, 0.005 to 0.500 mass % of Sb, 0.001 to 0.200 mass % of REM, 0.0002 to 0.3 mass % of Ga, 0.001 to 1.0 mass % of Ta, and 0.001 to 1.0 mass % of Hf.

3. The ferritic stainless steel according to claim 1, wherein a grain size number is 6 or more.

4. The ferritic stainless steel according to claim 1, wherein a thickness of the steel sheet is represented by t, in mm, and an average r-value is represented by $r_m$, and wherein $r_m$ satisfies a relationship of $r_m \geq -1.0t+3.0$.

5. The ferritic stainless steel according to claim 1, wherein the ferritic stainless steel sheet is suitable for use in an automobile component or a motorcycle component.

6. The ferritic stainless steel according to claim 1, wherein the ferritic stainless steel sheet is suitable for use in an automobile exhaust pipe, fuel tank or a fuel pipe.

7. A ferritic stainless steel pipe, comprising the ferritic stainless steel sheet according to claim 1.

8. The ferritic stainless steel according to claim 2, wherein a grain size number is 6 or more.

9. The ferritic stainless steel according to claim 2, wherein a thickness of the steel sheet is represented by t, in mm, and an average r-value is represented by $r_m$, and wherein $r_m$ satisfies a relationship of $r_m \geq -1.0t+3.0$.

10. The ferritic stainless steel according to claim 2, wherein the ferritic stainless steel sheet is suitable for use in an automobile component or a motorcycle component.

11. The ferritic stainless steel according to claim 2, wherein the ferritic stainless steel sheet is suitable for use in an automobile exhaust pipe, fuel tank or a fuel pipe.

12. A ferritic stainless steel pipe, comprising the ferritic stainless steel sheet according to claim 2.

13. The ferritic stainless steel according to claim 3, wherein a thickness of the steel sheet is represented by t, in mm, and an average r-value is represented by $r_m$, and wherein $r_m$ satisfies a relationship of $r_m \geq -1.0t+3.0$.

14. The ferritic stainless steel according to claim 8, wherein a thickness of the steel sheet is represented by t, in mm, and an average r-value is represented by $r_m$, and wherein $r_m$ satisfies a relationship of $r_m \geq -1.0t+3.0$.

* * * * *